US012624502B2

(12) United States Patent
Hu et al.

(10) Patent No.: US 12,624,502 B2
(45) Date of Patent: May 12, 2026

(54) LIGNOCELLULOSIC BIOPLASTICS AND COMPOSITES, AND METHODS FOR FORMING AND USE THEREOF

(71) Applicant: UNIVERSITY OF MARYLAND, COLLEGE PARK, College Park, MD (US)

(72) Inventors: Liangbing Hu, Rockville, MD (US); Chaoji Chen, Wuhan City (CN); Qinqin Xia, Harbin City (CN)

(73) Assignee: UNIVERSITY OF MARYLAND, COLLEGE PARK, College Park, MD (US)

( * ) Notice: Subject to any disclaimer, the term of this patent is extended or adjusted under 35 U.S.C. 154(b) by 314 days.

(21) Appl. No.: 18/026,653

(22) PCT Filed: Sep. 16, 2021

(86) PCT No.: PCT/US2021/050575
§ 371 (c)(1),
(2) Date: Mar. 16, 2023

(87) PCT Pub. No.: WO2022/060922
PCT Pub. Date: Mar. 24, 2022

(65) Prior Publication Data

US 2023/0340728 A1 Oct. 26, 2023

Related U.S. Application Data

(60) Provisional application No. 63/079,287, filed on Sep. 16, 2020.

(51) Int. Cl.
*D21H 11/20* (2006.01)

(52) U.S. Cl.
CPC ..... *D21H 11/20* (2013.01)

(58) Field of Classification Search
CPC ..... D21H 11/20
(Continued)

(56) References Cited

U.S. PATENT DOCUMENTS 6,602,994 B1 8/2003 Cash et al.
10,982,390 B2 4/2021 Hu et al.
(Continued)

FOREIGN PATENT DOCUMENTS

CA 1066697 A 11/1979
CA 2608174 A1 4/2009
(Continued)

OTHER PUBLICATIONS

CN Office Action, issued Jun. 5, 2025 (Jun. 5, 2025), in Chinese Patent Application No. 202180076699.8. (20 pages).
(Continued)

*Primary Examiner* — Jacob T Minskey
(74) *Attorney, Agent, or Firm* — RowanTree Law Group, PLLC; Frederick F. Rosenberger

(57) ABSTRACT

A solid lignocellulosic bioplastic can be formed from a biomass comprising an intertwined structure of lignin, hemicellulose, and cellulose. The lignin in the biomass can be dissolved such that the cellulose is fibrillated. After the lignin dissolution and cellulose fibrillation, the lignin can be regenerated in situ. The regenerated lignin can be deposited on and can form hydrogen bonds between the fibrillated cellulose, so as to form a slurry of lignin-cellulose solids in solution. The slurry can then be dried to form the bioplastic. In some embodiments, the lignin is dissolved by immersing the biomass in a first chemical. The lignin can then be regenerated in situ by addition of a second chemical to the first chemical.

18 Claims, 9 Drawing Sheets

(58) Field of Classification Search
USPC ..... 162/9
See application file for complete search history.

(56) References Cited

U.S. PATENT DOCUMENTS

| | | | | |
|---|---|---|---|---|
| 11,130,256 | B2 | 9/2021 | Hu et al. | |
| 11,440,214 | B2 | 9/2022 | Hu et al. | |
| 11,554,514 | B2 | 1/2023 | Hu et al. | |
| 11,958,209 | B2 | 4/2024 | Hu et al. | |
| 12,168,727 | B2 | 12/2024 | Hu et al. | |
| 2004/0145078 | A1 | 7/2004 | Merkley et al. | |
| 2012/0180964 | A1 | 7/2012 | Heinricher | |
| 2013/0020277 | A1* | 1/2013 | Berk | B65D 11/04 215/379 |
| 2017/0073852 | A1 | 3/2017 | Uno et al. | |
| 2018/0002514 | A1 | 1/2018 | Henry et al. | |
| 2018/0356127 | A1 | 12/2018 | Hu et al. | |
| 2019/0112764 | A1 | 4/2019 | Banu et al. | |
| 2019/0307923 | A1 | 10/2019 | Gatenholm et al. | |
| 2020/0248042 | A1 | 8/2020 | Holtan et al. | |
| 2021/0122902 | A1 | 4/2021 | Hu et al. | |
| 2022/0412002 | A1 | 12/2022 | Hu et al. | |
| 2023/0160141 | A1 | 5/2023 | Hu et al. | |
| 2023/0203311 | A1 | 6/2023 | Hu et al. | |
| 2023/0234258 | A1 | 7/2023 | Hu et al. | |
| 2023/0256645 | A1 | 8/2023 | Hu et al. | |
| 2024/0083067 | A1 | 3/2024 | Hu et al. | |

FOREIGN PATENT DOCUMENTS

| | | | |
|---|---|---|---|
| WO | WO 2008/044860 | A1 | 4/2008 |
| WO | WO 2009/056009 | A1 | 5/2009 |
| WO | WO 2011/157516 | A1 | 12/2011 |
| WO | WO 2015/185688 | A1 | 12/2015 |
| WO | WO 2015/187296 | | 12/2015 |
| WO | WO 2018/146341 | | 8/2018 |

OTHER PUBLICATIONS

Bi et al., "Transparent Wood Film Incorporating Carbon Dots as Encapsulating Material for White Light-Emitting Diodes," *ACS Sustainable Chemistry & Engineering*, 2018, 6: pp. 9314-9323. (10 pages).
Chen et al., "Isolation and characterization of cellulose nanofibers from four plant cellulose fibers using a chemical-ultrasonic process," *Cellulose*, 2011, 18: pp. 433-442. (10 pages).
Fu et al., "Wood-Based Flexible Electronics," *ACS Nano*, Feb. 2020, 14: pp. 3528-3538. (11 pages).
Fu, Denghao, "Advanced 'Green' Composites based on Agricultural By-Products," Master's Thesis, Cornell University, May 2020. (97 pages).
Guan et al., "Highly Compressible Wood Sponges with a Spring-like Lamellar Structure as Effective and Reusable Oil Absorbents," *ACS Nano*, 2018, 12: pp. 10365-10373. (9 pages).
Guo et al., "Short-time deep eutectic solvent pretreatment for enhanced enzymatic saccharification and lignin valorization," *Green Chemistry*, 2019, 21: pp. 3099-3108. (10 pages).
International Search Report and Written Opinion, mailed Dec. 28, 2021, in International Application No. PCT/US21/50575. (15 pages).
Jiang et al., "Lignin as a Wood-Inspired Binder Enabled Strong, Water Stable, and Biodegradable Paper for Plastic Replacement," *Advanced Functional Materials*, 2019, 1906307. (11 pages).
Khan et al., "Optimization of microfluidization for the homogeneous distribution of cellulose nanocrystals (CNCs) in biopolymeric matrix," *Cellulose*, 2014, 21: pp. 3457-3468. (12 pages).
Liu et al., "Efficient cleavage of lignin-carbohydrate complexes and ultrafast extraction of lignin oligomers from wood biomass using microwave-assisted deep eutectic solvent treatment," *ChemSusChem*, 2017, 10(8): pp. 1692-1700. (9 pages).
Nair et al., "Effect of high residual lignin on the thermal stability of nanofibrils and its enhanced mechanical performance in aqueous environments," *Cellulose*, 2015, 22: pp. 3137-3150. (14 pages).
Nair et al., "Investigating the effect of lignin on the mechanical, thermal, and barrier properties of cellulose nanofibril reinforced epoxy composite," *Industrial Crops and Products*, 2017, 100: pp. 208-217. (10 pages).
Nishiwaki-Akine et al., "Transparent Woody Film Made by Dissolution of Finely Divided Japanese Beech in Formic Acid at Room Temperature," *ACS Sustainable Chemistry & Engineering*, Nov. 2017, 5: pp. 11536-11542. (7 pages).
Solala et al., "On the potential of lignin-containing cellulose nanofibrils (LCNFs): a review on properties and applications," *Cellulose*, 2020, 27: pp. 1853-1877. (25 pages).
Vigier et al., "Contribution of Deep Eutectic Solvents for Biomass Processing: Opportunities, Challenges, and Limitations," *ChemCatChem*, 2015, 7(8): pp. 1250-1260. (12 pages).
Wang et al., "Plasticizing cell walls as a strategy to produce wood-plastic composites with high wood content by extrusion processes," *BioResources*, 2011, 6(4): pp. 3621-3622. (2 pages).
Wang et al., "Reduction of lignin color via one-step UV irradiation," *Green Chemistry*, 2016, 18: pp. 695-699. (5 pages).
Wicaksono et al., "Cellulose Nanofibers from Cassava Bagasse: Characterization and Application on Tapioca-Film," *Chemistry and Materials Research*, 2013, 3(13): pp. 79-87. (9 pages).
Xie et al., "Recent Strategies in Preparation of Cellulose Nanocrystals and Cellulose Nanofibrils Derived from Raw Cellulose Materials," *International Journal of Polymer Science*, Apr. 2018, 2018(7923068): pp. 1-25. (26 pages).
Yang et al., "Applications of Lignocellulosic Fibers and Lignin in Bioplastics: A Review," *Polymers*, Apr. 2019, 11(751): pp. 1-26. (26 pages).
Zhu et al., "Anisotropic, Transparent Films with Aligned Cellulose Nanofibers," *Advanced Materials*, 2017, 1606284. (8 pages).
Agrawal et al., "Activation energy and crystallization kinetics of untreated and treated oil palm fibre reinforced phenol formaldehyde composites," *Materials Science and Engineering*, 2000, A277: pp. 77-82. (6 pages).
Chen et al., "Rapid Processing of Whole Bamboo with Exposed, Aligned Nanofibrils toward a High-Performance Structural Material," *ACS Nano*, Apr. 2020, 14: pp. 5194-5202. (9 pages).
Dixon et al., "Comparison of the flexural behavior of natural and thermo-hydromechanically densified Moso bamboo," *Eur. J. Wood. Prod.*, Apr. 2016, 74: pp. 633-642. (10 pages).
EP Office Action, issued Feb. 16, 2024 (Feb. 16, 2024), in European Patent Application No. 21870183.7. (13 pages).
Gan et al., "Single-digit-micrometer thickness wood speaker," *Nature Communications*, Nov. 2019, 10: paper No. 5084. (8 pages).
Geng et al., "Effect of Delignification on Hemicellulose Extraction from Switchgrass, Poplar, and Pine and Its Effect on Enzymatic Convertibility of Cellulose-rich Residues," *BioResources*, May 2018, 13(3): pp. 4946-4963. (19 pages).
Jiang et al., "High production yield and more thermally stable lignin-containing cellulose nanocrystals isolated using ternary acidic deep eutectic solvent," *ACS Sustainable Chemistry & Engineering*, 2020, 8: pp. 7182-7191. (10 pages).
Kalali et al., "Highly-aligned cellulose fibers reinforced epoxy composites derived from bulk natural bamboo," *Industrial Crops & Products*, 2019 (available online Dec. 2018), 129: pp. 434-439. (6 pages).
Kumar et al., "Engineered bamboo scrimber: Influence of density on the mechanical and water absorption properties," *Construction and Building Materials*, Oct. 2016, 127: pp. 815-827. (13 pages).
Osorio et al., "In-depth study of the microstructure of bamboo fibres and their relation to the mechanical properties," *Journal of Reinforced Plastics & Composites*, Jun. 2018, 37(17): pp. 1099-1113. (15 pages).
Park, Choong Nyeon, "Flattening of Bamboo by Thermo mechanical Treatment," *10th World Bamboo Congress*, Korea 2015, 2015. (7 pages).
Sharma et al., "Effect of processing methods on the mechanical properties of engineered bamboo," *Construction and Building Materials*, Mar. 2015, 83: pp. 95-101. (7 pages).
Sharma et al., "Engineered bamboo for structural applications," *Construction and Building Materials*, Feb. 2015, 81: pp. 66-73. (8 pages).

(56) References Cited

OTHER PUBLICATIONS

Sirvio et al., "Anionic wood nanofibers produced from unbleached mechanical pulp by highly efficient chemical modification," *Journal of Materials Chemistry A*, 2017, 41: pp. 21828-35. (10 pages).
Valadez-Gonzalez et al., "Chemical modification of henequen fibers with an organosilane coupling agent," *Composites: Part B*, 1999, pp. 321-331. (11 pages).
Xia et al., "A strong, biodegradable and recyclable lignocellulosic bioplastic," *Nature Sustainability*, Jul. 2021, 4: pp. 627-635. (19 pages).
Yang et al., "Effects of different thermal modification media on physical and mechanical properties of moso bamboo," *Construction and Building Materials*, May 2016, 119: pp. 251-259. (9 pages).
SG Office Action, issued Oct. 26, 2025, in Singapore Application No. 11202301998T. (7 pages).

* cited by examiner

LIGNOCELLULOSIC BIOPLASTICS AND COMPOSITES, AND METHODS FOR FORMING AND USE THEREOF

CROSS-REFERENCE TO RELATED APPLICATION

The present application claims the benefit of U.S. Provisional Application No. 63/079,287, filed Sep. 16, 2020, entitled "Bio-based Composite Materials and Methods of Making the Same," which is incorporated by reference herein in its entirety.

FIELD

The present disclosure relates generally to biomass-derived materials, and more particularly, to lignocellulosic bioplastics and composites, and methods of forming and using such materials.

BACKGROUND

Bioplastics are plastic materials at least partially formed from renewable biomass sources (e.g., plant or animal material). When made from different biomass feedstocks, bioplastics can reduce the reliance on fossil fuels and diminish greenhouse gas emissions. While some bioplastics may be biodegradable, other bioplastics may not be biodegradable or biodegrade at a rate similar to fossil-fuel derived plastics. Conventional bioplastics can be synthesized using delignification, chemical crosslinking, or modification of natural fibers. However, these approaches can employ toxic chemicals and involve complex processing steps associated with high manufacturing costs. Moreover, conventional bioplastics may have sub-optimal mechanical strength and stability upon exposure to water, for example, due to weak interfacial bonding and the hydrophilicity of cellulose and/or hemicellulose therein. Embodiments of the disclosed subject matter may address one or more of the above-noted problems and disadvantages, among other things.

SUMMARY

Embodiments of the disclosed subject matter system provide an in situ lignin regeneration strategy to synthesize a high-performance bioplastic from lignocellulosic biomass. In this process, the native structure of the biomass can be deconstructed to form a homogeneous cellulose-lignin slurry that features nanoscale entanglement and hydrogen bonding between the regenerated lignin and cellulose micro/nanofibrils. The resulting lignocellulosic bioplastic exhibits high mechanical strength, excellent water stability, UV-light resistance, and improved thermal stability. Furthermore, the lignocellulosic bioplastic has a lower environmental impact as it can be easily recycled or safely biodegraded in the natural environment.

In one or more embodiments, a method comprises dissolving lignin in a biomass. The biomass can comprise an intertwined structure of lignin, hemicellulose, and cellulose. As a result of the lignin dissolution, the cellulose in the biomass can be fibrillated. The method can further comprise, after the lignin dissolution, in situ regenerating the lignin such that the regenerated lignin is deposited on and forms hydrogen bonds between the fibrillated cellulose. As a result, a slurry of lignin-cellulose solids in solution can be formed. The method can also comprise, after the lignin regeneration, drying the slurry to form a solid lignocellulosic bioplastic.

In one or more embodiments, a bioplastic can comprise fibrillated cellulose and regenerated lignin. The fibrillated cellulose can be in a form of microfibrils or nanofibrils having a cross-sectional dimension less than or equal to 300 nm. The regenerated lignin can be deposited on and can form hydrogen bonds between the fibrillated cellulose so as to form an interconnected network. The regenerated lignin and the fibrillated cellulose can be derived from a same biomass that had an intertwined structure of native lignin, hemicellulose, and cellulose. The regenerated lignin can be chemically modified as compared to the native lignin in the biomass.

Any of the various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosed technology will become more apparent from the following detailed description, which proceeds with reference to the accompanying figures.

BRIEF DESCRIPTION OF THE DRAWINGS

Embodiments will hereinafter be described with reference to the accompanying drawings, which have not necessarily been drawn to scale. Where applicable, some elements may be simplified or otherwise not illustrated in order to assist in the illustration and description of underlying features. Throughout the figures, like reference numerals denote like elements.

3.0-5.5) and aromatic regions ($\delta_C/\delta_H$ 95-135/6.3-8.0) for native lignin from milled wood and in situ regenerated lignin, respectively.

Figure 3A:
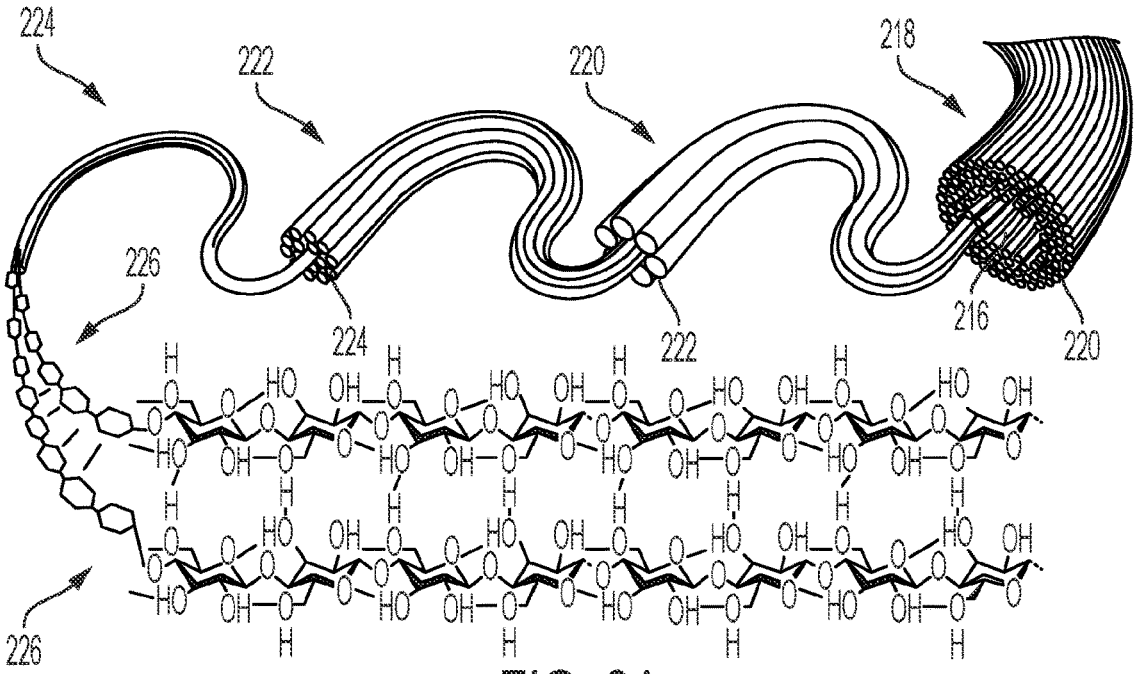
FIG. 3A is a simplified schematic diagram illustrating the hierarchical aligned structure of cellulose fibers in natural wood.
Figure 3B:
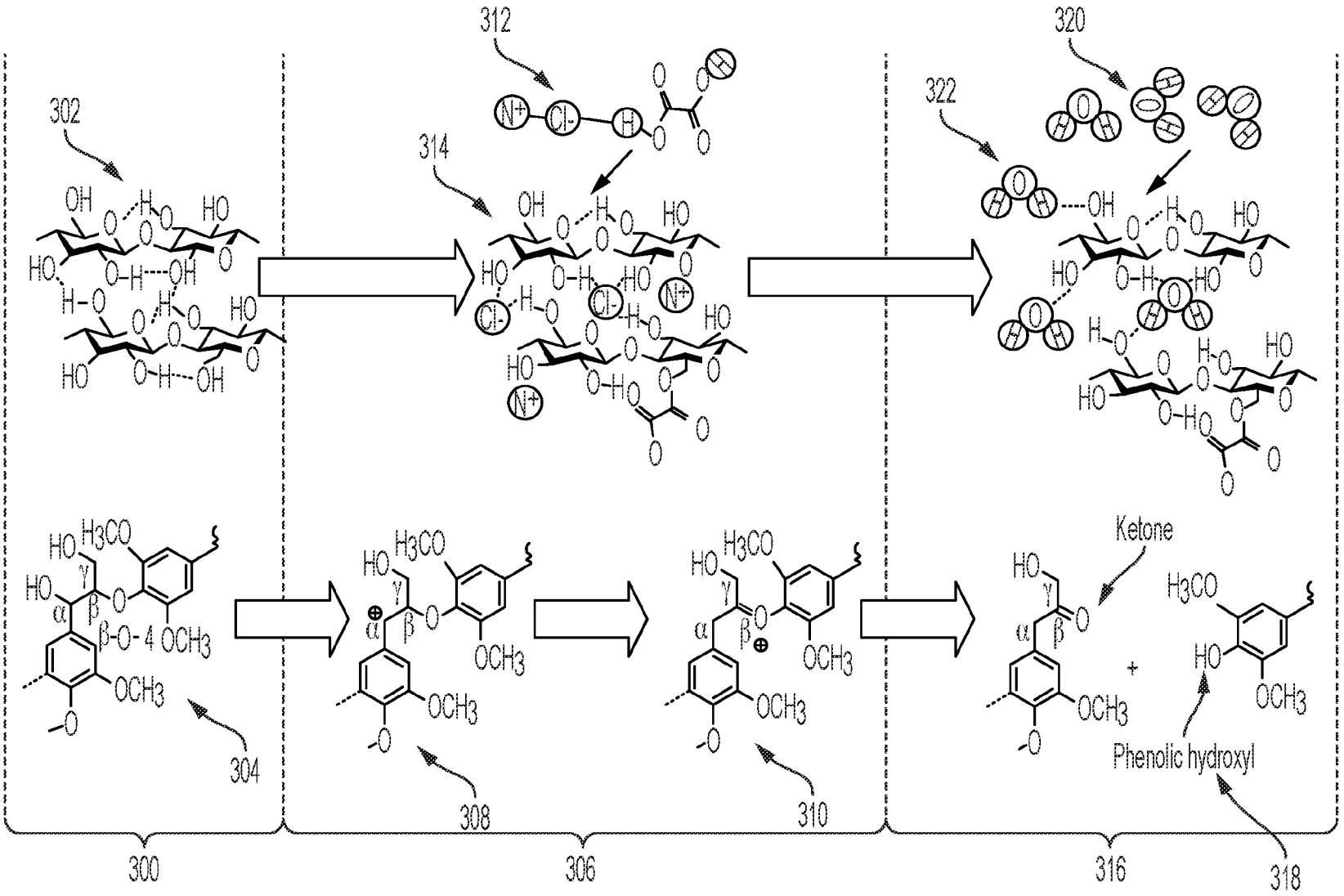
FIG. 3B shows the evolution of the chemical structures of cellulose (top row) and lignin (bottom row) by an exemplary process for lignin dissolution from a biomass and subsequent in situ regeneration.
Figure 3C:
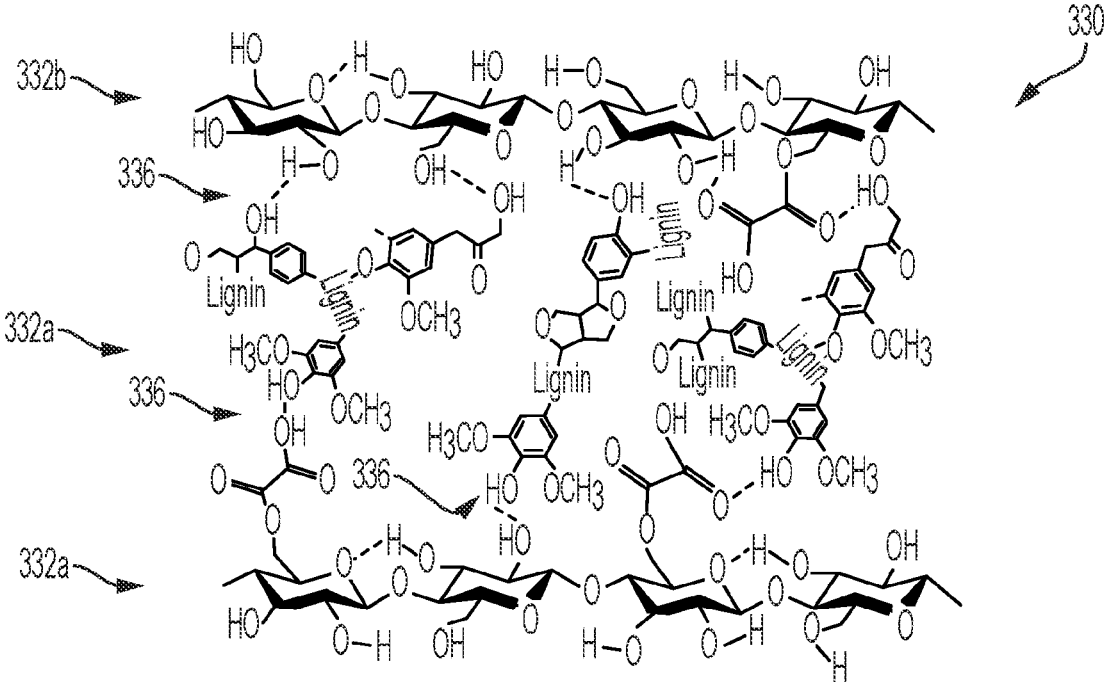
FIG. 3C shows the relative structural linkages between regenerated lignin and cellulose micro/nanofibrils in an exemplary bioplastic.
Figure 3D:
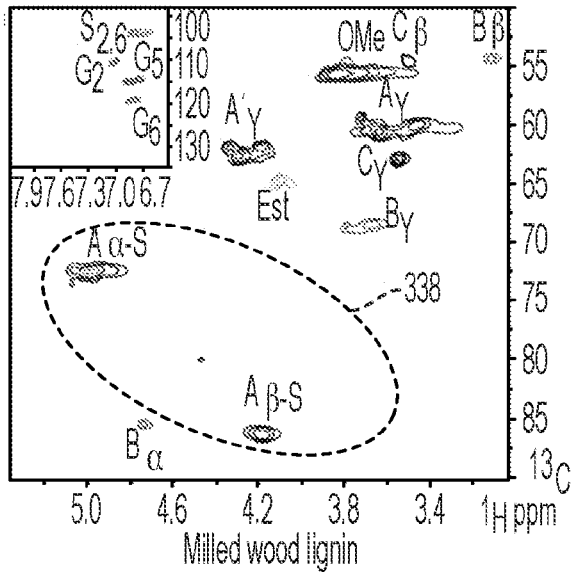
FIGS. 3D-3E are graphs of 2D-Heteronuclear Single-Quantum Correlation (2D-HSQC) nuclear magnetic resonance (NMR) spectra of side-chain regions ($\delta_C/\delta_H$ 50-90/
Figure 3E:
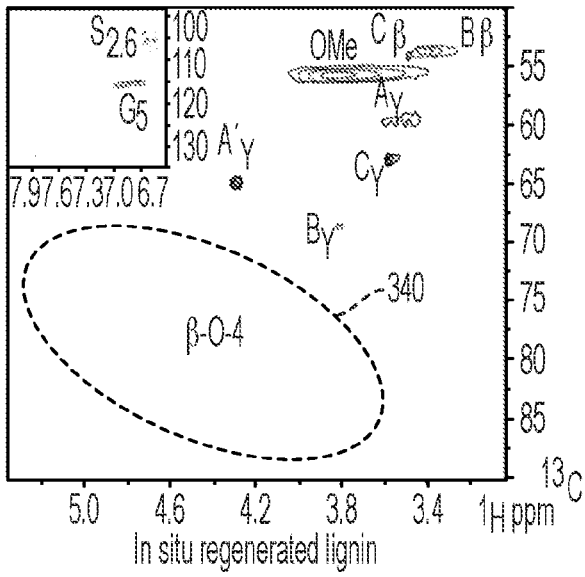
Figure 3F:
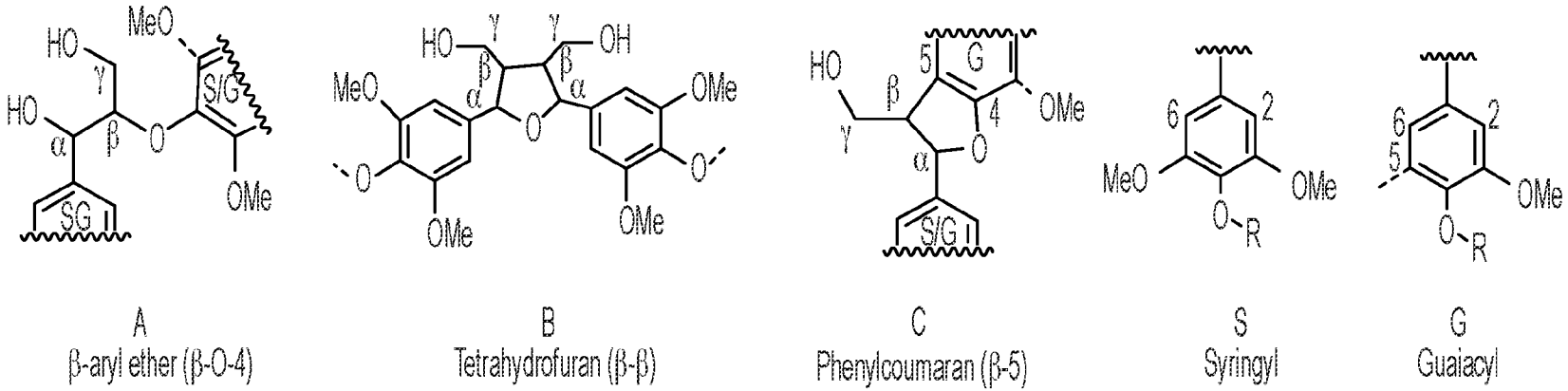

FIG. 3F illustrates the chemical structure for regions A-C, G, and S of FIGS. 3D-3E.

Figure 4:
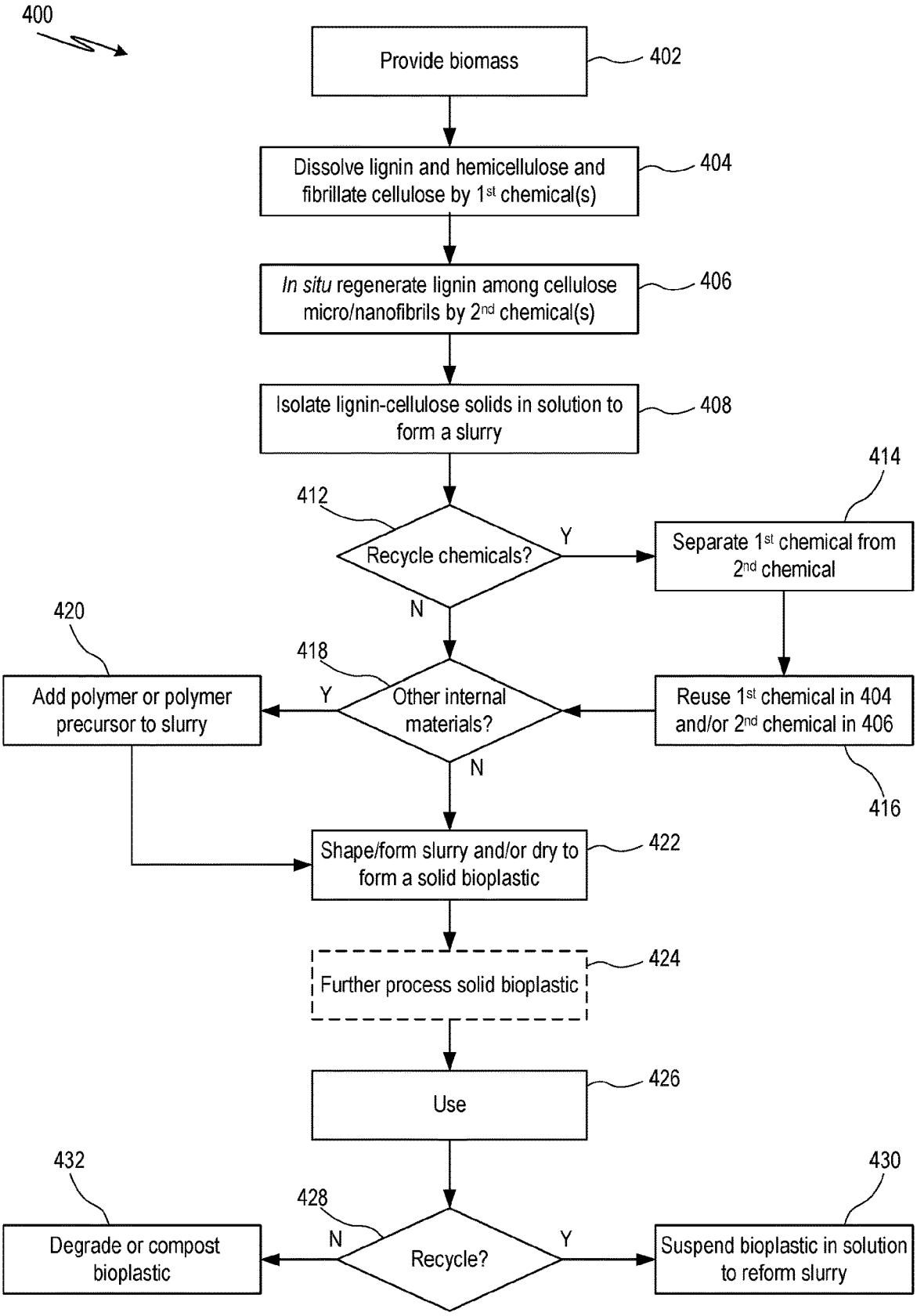

FIG. 4 illustrates an exemplary method for formation and use of a bioplastic, according to one or more embodiments of the disclosed subject matter.

Figure 5A:
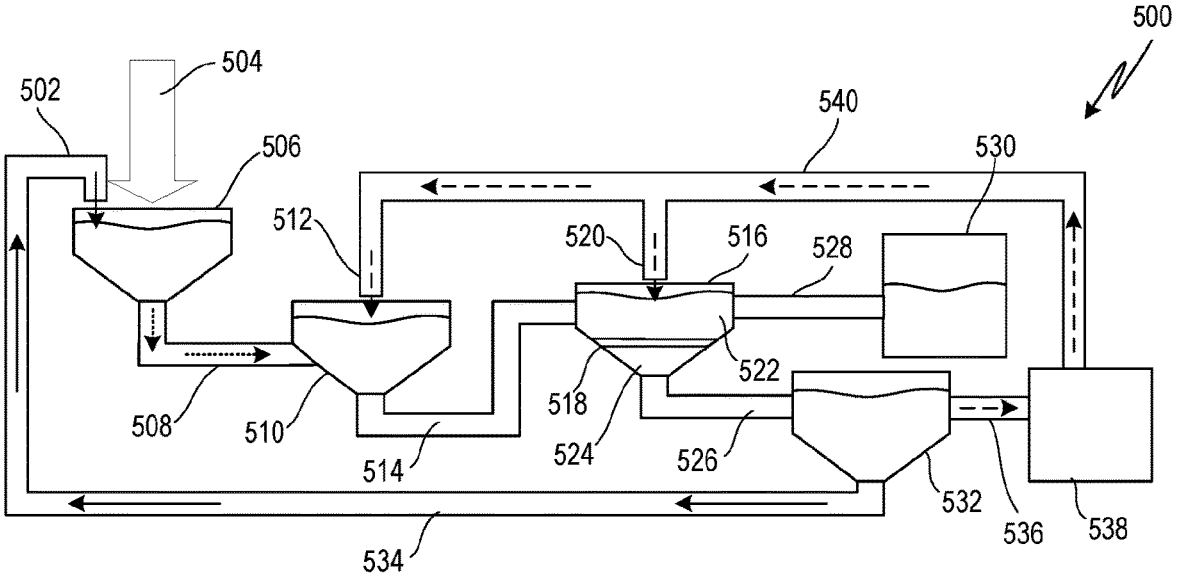

FIG. 5A is a simplified schematic diagram of an exemplary system for forming a slurry of lignin-cellulose solids in solution from a biomass, according to one or more embodiments of the disclosed subject matter.

Figure 5B:
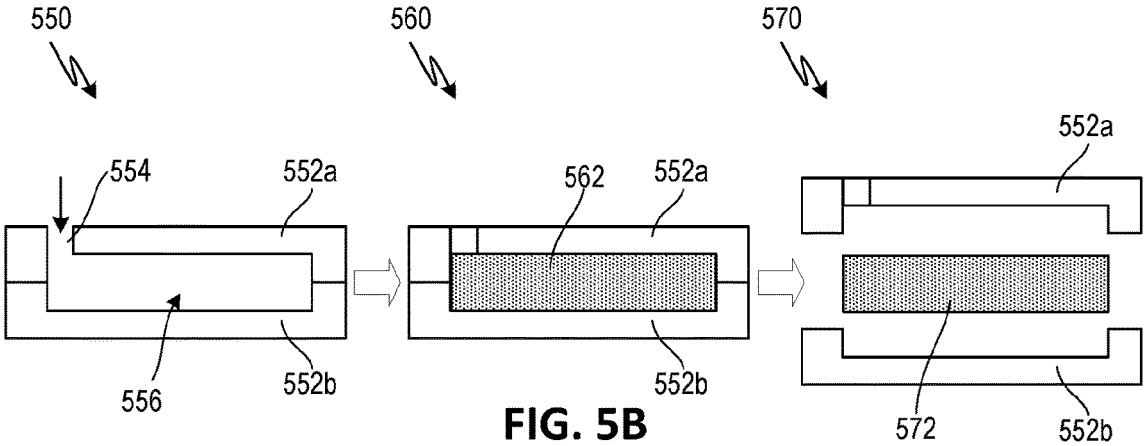

FIG. 5B is a simplified schematic diagram of an exemplary system for molding a lignin-cellulose slurry into a bioplastic, according to one or more embodiments of the disclosed subject matter.

Figure 5C:
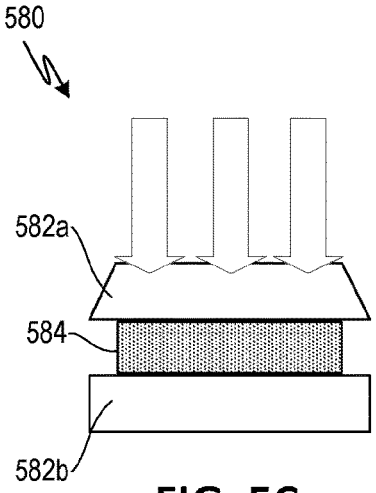

FIG. 5C is a simplified schematic diagram of an exemplary pressing system for forming a densified bioplastic, according to one or more embodiments of the disclosed subject matter.

Figure 5D:
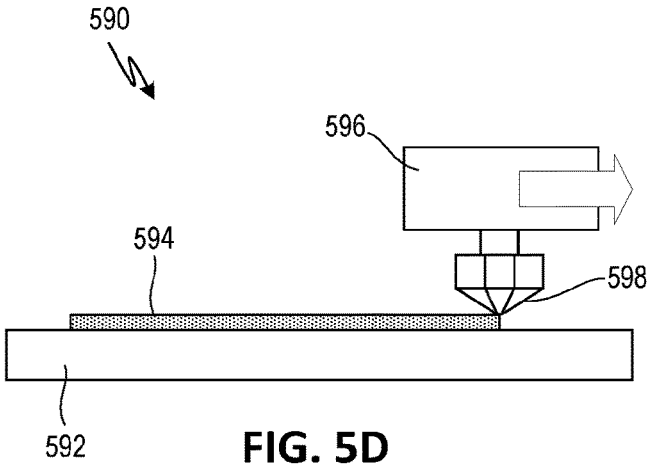

FIG. 5D is a simplified schematic diagram of an exemplary additive manufacturing system for printing a lignin-cellulose slurry to form a bioplastic, according to one or more embodiments of the disclosed subject matter.

Figure 6A:
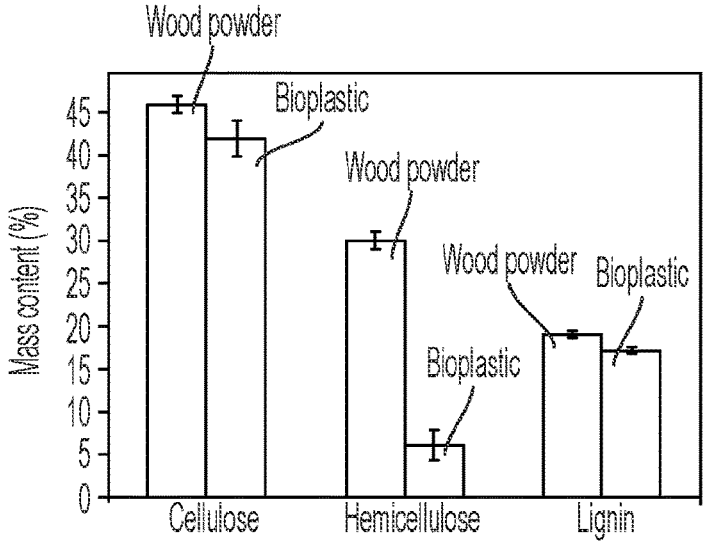

FIG. 6A is a graph comparing the chemical composition of wood powder to the chemical composition of a fabricated lignocellulosic bioplastic.

Figure 6B:
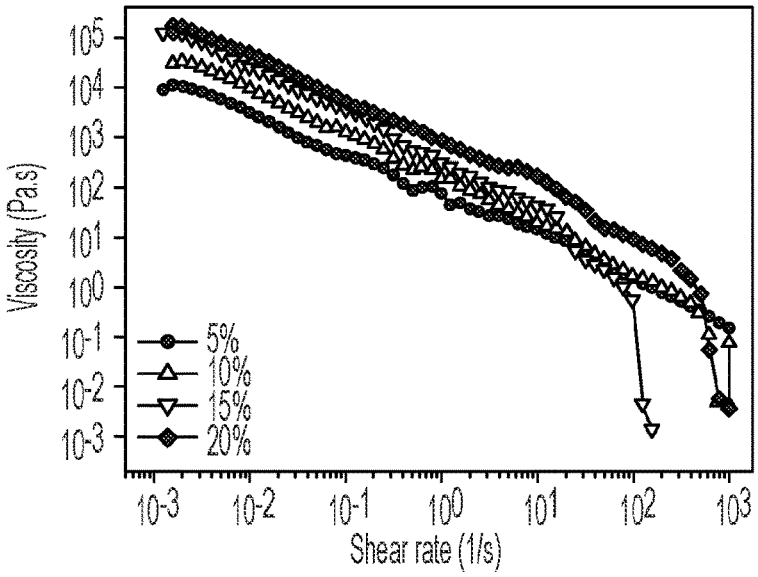

FIG. 6B is a graph of viscosity versus shear rate for fabricated slurries having different content (wt %) of lignin-cellulose solids.

Figure 6C:
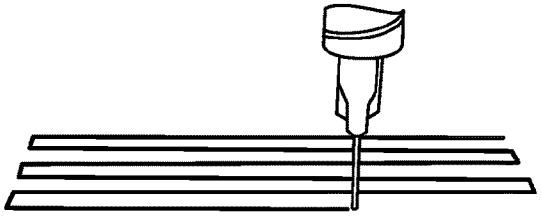

FIG. 6C is an image of an additive manufacturing setup depositing lignin-cellulose slurry to form arbitrary-shaped bioplastic structures.

Figure 7A:
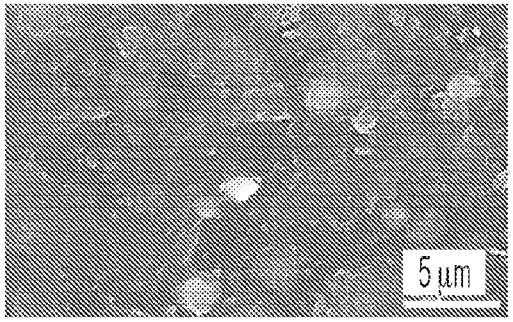
Figure 7B:
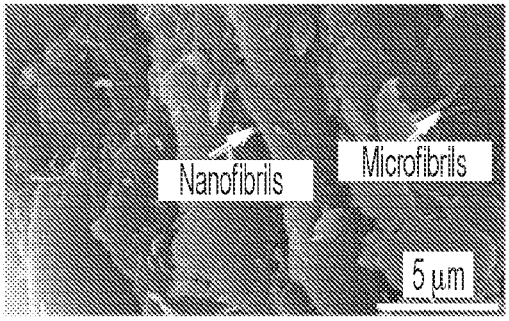

FIGS. 7A-7B are scanning electron microscopy (SEM) images of external surfaces of a fabricated bioplastic.

Figure 7C:
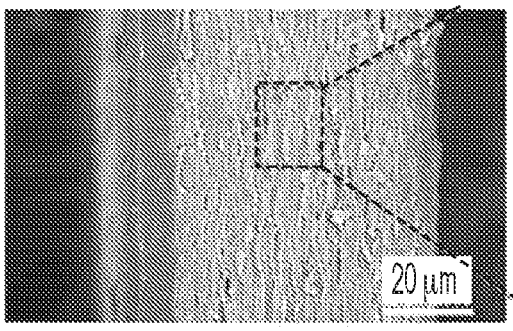

FIG. 7C is an SEM image of a cross-sectional surface of a fabricated bioplastic.

Figure 7D:
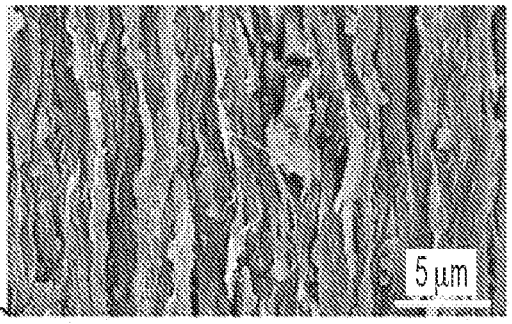

FIG. 7D is a magnified SEM image of a portion of the cross-sectional surface of FIG. 7C.

Figure 7E:
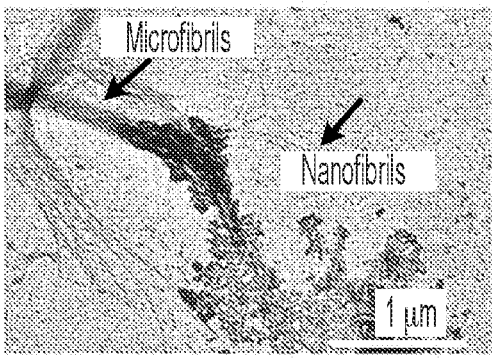
Figure 7F:
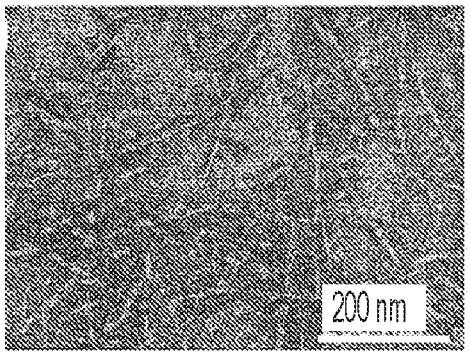
Figure 7G:
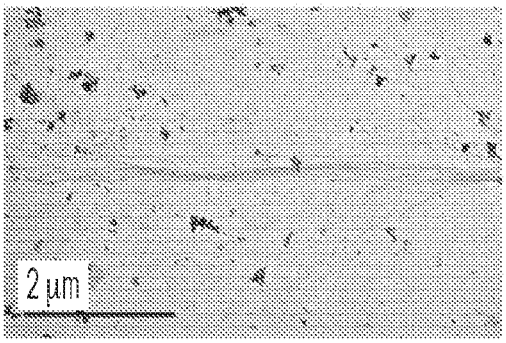

FIGS. 7E and 7G are transmission electron microscopy (TEM) images illustrating microfibrils and nanofibrils in a fabricated bioplastic.

FIG. 7F is a TEM image illustrating nanofibrils in a fabricated bioplastic.

Figure 7H:
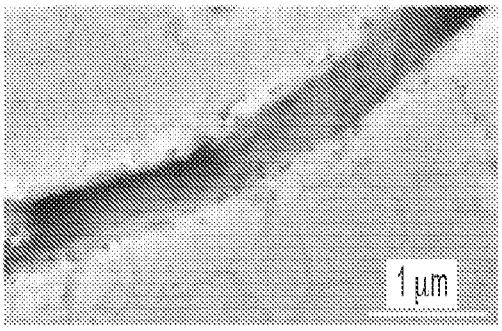

FIG. 7H is a TEM image showing in situ regenerated lignin coating a microfibril in a fabricated bioplastic.

Figure 8A:
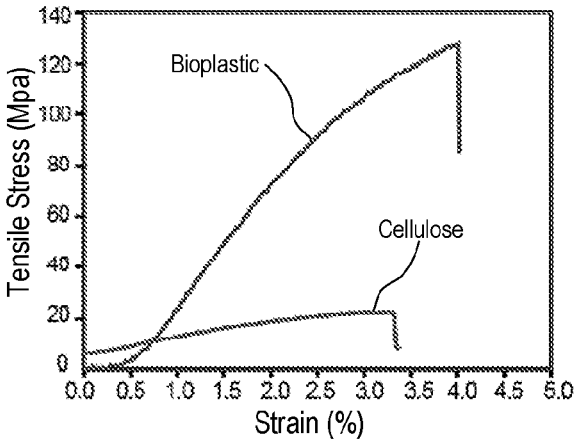

FIG. 8A is a graph of tensile stress-strain performance of cellulose film and a fabricated bioplastic.

Figure 8B:
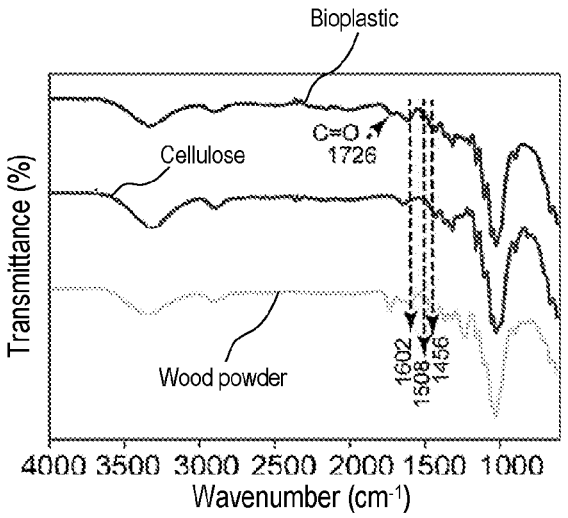

FIG. 8B is a graph of Fourier-transform infrared (FTIR) spectra for wood powder, cellulose, and a fabricated bioplastic.

Figure 8C:
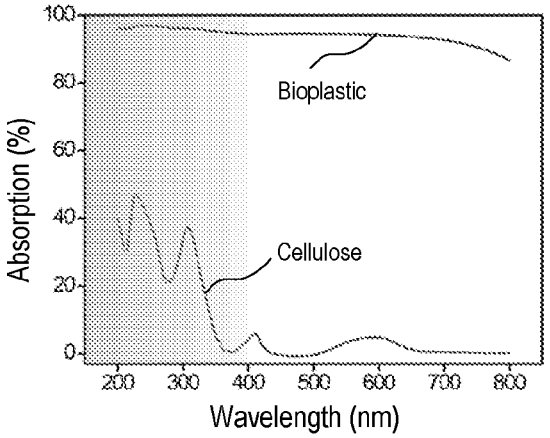
Figure 8D:
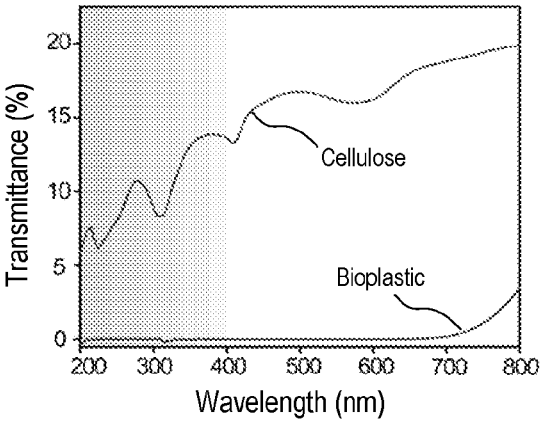

FIGS. 8C-8D are graphs of absorption and transmission spectra, respectively, for a cellulose film and a fabricated bioplastic.

Figure 8E:
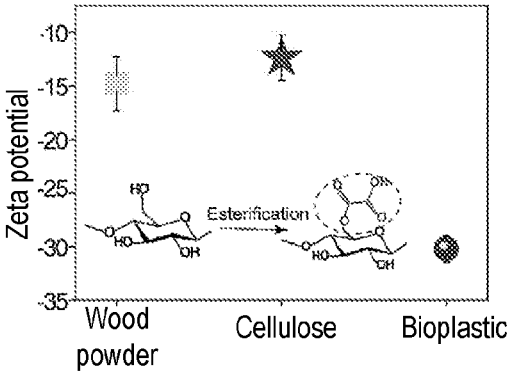
Figure 8F:
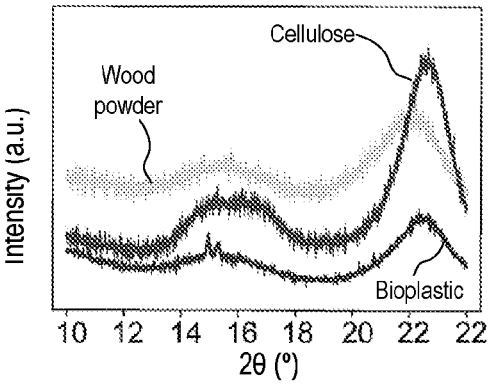

FIGS. 8E-8F are graphs of zeta potential and X-ray diffraction (XRD) spectra, respectively, for wood powder, cellulose, and a fabricated bioplastic.

DETAILED DESCRIPTION

General Considerations

For purposes of this description, certain aspects, advantages, and novel features of the embodiments of this disclosure are described herein. The disclosed methods and systems should not be construed as being limiting in any way. Instead, the present disclosure is directed toward all novel and nonobvious features and aspects of the various disclosed embodiments, alone and in various combinations and subcombinations with one another. The methods and systems are not limited to any specific aspect or feature or combination thereof, nor do the disclosed embodiments require that any one or more specific advantages be present, or problems be solved. The technologies from any embodiment or example can be combined with the technologies described in any one or more of the other embodiments or examples. In view of the many possible embodiments to which the principles of the disclosed technology may be applied, it should be recognized that the illustrated embodiments are exemplary only and should not be taken as limiting the scope of the disclosed technology.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of skill in the art.

The disclosure of numerical ranges should be understood as referring to each discrete point within the range, inclusive of endpoints, unless otherwise noted. Unless otherwise indicated, all numbers expressing quantities of components, molecular weights, percentages, temperatures, times, and so forth, as used in the specification or claims are to be understood as being modified by the term "about." Accordingly, unless otherwise implicitly or explicitly indicated, or unless the context is properly understood by a person of skill in the art to have a more definitive construction, the numerical parameters set forth are approximations that may depend on the desired properties sought and/or limits of detection under standard test conditions/methods, as known to those of skill in the art. When directly and explicitly distinguishing embodiments from discussed prior art, the embodiment numbers are not approximates unless the word "about" is recited. Whenever "substantially," "approximately," "about," or similar language is explicitly used in combination with a specific value, variations up to and including 10% of that value are intended, unless explicitly stated otherwise.

Directions and other relative references may be used to facilitate discussion of the drawings and principles herein, but are not intended to be limiting. For example, certain terms may be used such as "inner," "outer,", "upper," "lower," "top," "bottom," "interior," "exterior," "left," right," "front," "back," "rear," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same.

As used herein, "comprising" means "including," and the singular forms "a" or "an" or "the" include plural references unless the context clearly dictates otherwise. The term "or" refers to a single element of stated alternative elements or a combination of two or more elements, unless the context clearly indicates otherwise.

Although there are alternatives for various components, parameters, operating conditions, etc. set forth herein, that does not mean that those alternatives are necessarily equivalent and/or perform equally well. Nor does it mean that the alternatives are listed in a preferred order, unless stated otherwise. Unless stated otherwise, any of the groups defined below can be substituted or unsubstituted.

Unless explained otherwise, all technical and scientific terms used herein have the same meaning as commonly understood to one of skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Features of the presently disclosed subject matter will be apparent from the following detailed description and the appended claims.

Overview of Terms

The following explanations of specific terms and abbreviations are provided to facilitate the description of various aspects of the disclosed subject matter and to guide those of skill in the art in the practice of the disclosed subject matter.

Biomass: Any native fibrous plant material, i.e., a photosynthetic eukaryote of the kingdom Plantae. In general, the plant material is composed of cellulose, lignin, and hemicellulose forming an intertwined structure. In other embodiments, the plant material can be any type of fibrous plant that has a lignin-cellulose matrix. In some embodiments, the fibrous plant material is a hardwood, softwood, bamboo, grass, hemp, or reed. In some embodiments, the biomass is a mechanically-processed or waste portion of a plant material, such as but not limited to a wood chi5p, wood powder, sawdust, bagasse, wheat straw, coconut shell, haulm, or corn stalk.

Aerogel: An open-celled, mesoporous, solid foam composed of a network of interconnected nanostructures and that exhibits a porosity (e.g., non-solid or air-filled volume) of no less than 50%.

In situ lignin regeneration: The conversion of dissolved lignin back into a solid form in the presence of cellulose microfibrils and/or nanofibrils, such the lignin becomes deposited on and forms hydrogen bonds between the cellulose microfibrils and/or nanofibrils. This is in contrast to lignin regeneration that occurs separate from the cellulose, and in which the solid lignin is subsequently mixed with the cellulose to form a lignocellulosic mixture.

Modified lignin: Modification of the chemical structure of lignin with respect to the lignin in its native form within the biomass. In some embodiments, after dissolution and in situ regeneration, the lignin has been modified such that β-O-4 ether bonds are cleaved as compared to the native lignin, and/or such that hydroxyl groups are more phenolic as compared to the native lignin. In some embodiments, the lignin content before and after the modification is substantially the same. Lignin content can be assessed using known techniques in the art, for example, Laboratory Analytical Procedure (LAP) TP-510-42618 for "Determination of Structural Carbohydrates and Lignin in Biomass," Version Aug. 3, 2012, published by National Renewable Energy Laboratory (NREL), and ASTM E1758-01 (2020) for "Standard Test Method for Determination of Carbohydrates in Biomass by High Performance Liquid Chromatography," published by ASTM International, both of which are incorporated herein by reference.

Modified cellulose: Modification of the chemical structure of cellulose with respect to the cellulose in its native form within the biomass. In some embodiments, after lignin dissolution and in situ regeneration, the cellulose can be esterified such that a-COO functional group has a negative charge.

Introduction

In one or more embodiments of the disclosed subject, a biomass is immersed in solution to cause lignin and hemicellulose therein to dissolve, thereby releasing cellulose microfibrils and/or nanofibrils (e.g., fibrillating the cellulose) that were previously bound together into bundles by the lignin-hemicellulose matrix. The dissolved lignin can then be in situ regenerated (e.g., to precipitate from the solution) to deposit on the dispersed cellulose microfibrils and/or nanofibrils. In some embodiments, the hemicellulose (e.g., most of the hemicellulose, or at least a majority of the native content of the hemicellulose) can remain dissolved in solution. The resulting lignin-cellulose solids in solution can be formed into a slurry, which can be used to form a solid lignocellulosic bioplastic, e.g., by drying the slurry.

In some embodiments, the disclosed in situ lignin regeneration approach can produce bioplastic that exhibits high mechanical strength (e.g., tensile strength greater than 100 MPa, such as ~128 MPa), improved water and thermal stability, excellent recyclability, excellent biodegradability, and relatively low cost. In some conventional fabrication approaches, a bioplastic is formed by separating and isolating lignin and cellulose, which is an expensive and energy-intensive process. In contrast, the disclosed approach employs the temporary dissolution of lignin to allow cellulose fibrillation in solution and subsequent in situ regeneration of the lignin in the same solution to form a bioplastic precursor. Some conventional fabrication approaches also delignify the biomass and treat the extract lignin as manufacturing waste. In contrast, the disclosed approach can fully utilize the lignocellulosic components of the biomass, thereby providing more efficient material usage. Moreover, by retaining the lignin (e.g., via in situ regeneration) rather than disposing as waste, the resulting slurry of lignin-cellulose solids in solution can be substantially homogeneous and highly viscous, with the lignin filling the spaces between cellulose microfibrils and nanofibrils. The solid bioplastic formed from the slurry can thus result in a highly dense structure.

In some embodiments, the resulting lignocellulosic bioplastic can be recycled (e.g., processed for reformation as another bioplastic structure), for example, by mechanical processing (e.g., cutting and agitation) and immersion in solution (e.g., water) to reconstitute a lignin-cellulose slurry. Alternatively or additionally, in some embodiments, the resulting lignocellulosic bioplastic can be biodegraded, for example, via digestion by microorganisms in soil or compost. Accordingly, embodiments of the disclosed subject matter can provide a bioplastic that is mechanically strong and robust during service but capable of biodegradation or simple recycling after service, thereby offering a unique balance between degradability and durability that conventional petroleum-derived plastics or conventional bioplastics have been incapable of achieving.

Figure 1:
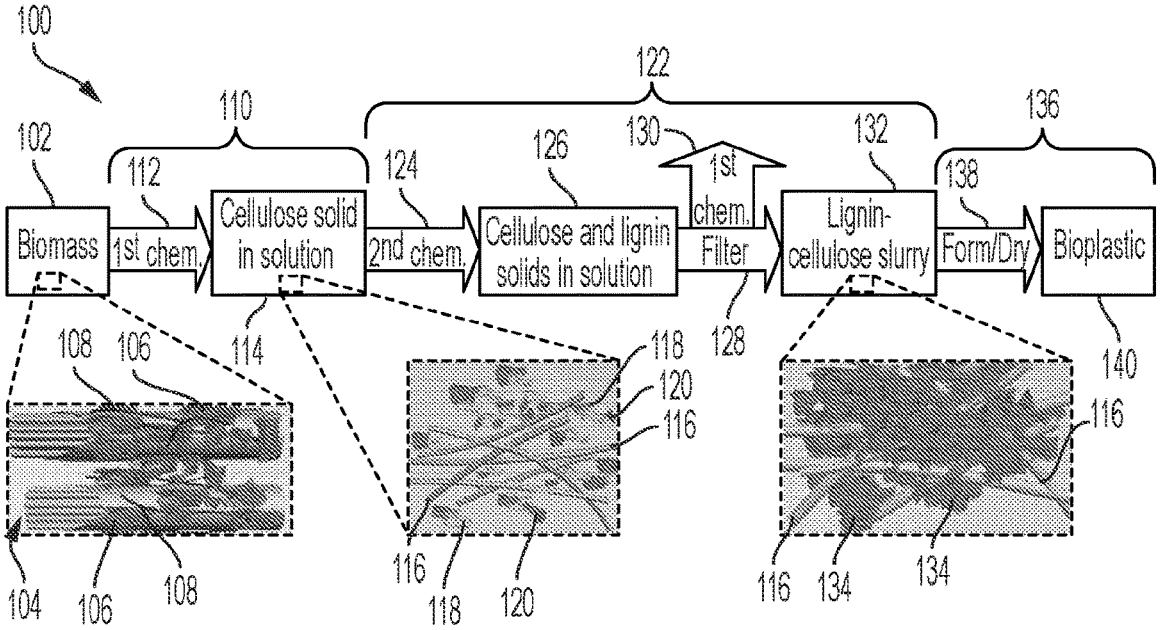
FIG. 1 is a simplified schematic diagram illustrating various aspects of forming a lignocellulosic bioplastic, according to one or more embodiments of the disclosed subject matter.

Referring to FIG. 1, an exemplary generalized process 100 of forming a bioplastic 140 from a biomass 102 is shown. The biomass 102 can be any type of native (e.g., as grown) plant material, such as wood, bamboo, grass, hemp, or reed. In general, a microstructure of the biomass 102 can comprise an intertwined structure of lignin, hemicellulose, and cellulose. For example, the microstructure of the biomass 102 can be defined by fibers or bundles 104 (e.g., having a maximum cross-sectional dimension in a plane perpendicular to a direction of extension of 50-100 μm) of cellulose microfibrils and/or nanofibrils held together by native lignin 106 and hemicellulose 108. In some embodiments, the biomass 102 can be a mechanically processed (e.g., ground or milled) or otherwise be considered a waste portion of the plant material, such as but not limited to wood chips, wood powder, sawdust, bagasse, wheat straw, coconut shell, haulm, or corn stalk.

In an initial stage 110, the biomass can be processed to dissolve the lignin and the hemicellulose therein while retaining the cellulose in solid form. For example, in some embodiments, the initial stage 110 includes immersion 112 of the biomass in a solution of one or more first chemical(s) 118, such that lignin 120 is dissolved therein. The cellulose microfibrils and/or nanofibrils 116 (e.g., having a maximum cross-sectional diameter in a plane perpendicular to a direction of extension of 10-300 nm) can thus be released from the bundles 104 into solution, thereby fibrillating the cellulose (e.g., with or without mechanical agitation).

In a subsequent stage 122, the dissolved lignin can be regenerated (e.g., precipitated) from the first chemical(s) to return the lignin to solid form, which lignin 134 can combine with the fibrillated cellulose 116 in solution to form a slurry 132. For example, in some embodiments, one or more second chemical(s) 124 can be added to the solution with the first chemical(s) and fibrillated cellulose to regenerate the lignin in situ. In some embodiments, the in situ regenerated lignin 134 can deposit on surfaces of the cellulose micro/nanofibrils 116 and can form hydrogen bonds therebetween. In some embodiments, the exposure of the lignin to the first chemical(s) and/or second chemical(s) can modify the lignin (e.g., a chemical composition or structure thereof). Alternatively or additionally, in some embodiments, the exposure of the cellulose to the first chemical(s) and/or second chemical(s) can modify the cellulose (e.g., a chemical composition or structure thereof). The resulting cellulose and lignin solids in solution 126 can then be further processed, for example, to remove the first chemical(s) 130 and concentrate or isolate the lignin-cellulose solids to form the slurry 132.

In some embodiments, after addition of the second chemical(s), the hemicellulose remains dissolved in the first chemical(s), such that the removal at 130 also removes substantially all, or at least a majority of, the native hemicellulose from the resulting slurry 132. In some embodiments, the cellulose and lignin solids can be isolated from the first chemical(s) by filtration 128 (e.g., vacuum filtration). Alternatively or additionally, the first chemical(s) can be evaporated from the solution, thereby leaving behind the cellulose and lignin solids in the remaining solution. In some embodiments, instead of or in addition to addition of second chemical(s) 124, the lignin can be regenerated by evaporating the first chemical(s), for example, when the first chemical(s) comprises an organic solvent. In such embodiments, the removal of first chemical(s) 130 by evaporation can be performed together with the in situ lignin regeneration by evaporation.

In a subsequent stage 136, the lignin-cellulose slurry can be further processed to form a solid lignocellulosic bioplastic. For example, in some embodiments, the slurry can be cast, disposed, dispensed, molded, or otherwise formed into a desired shape and then dried at 138 to form the bioplastic 140. In some embodiments, the slurry can be dried at room temperature or an elevated temperature, such that the solution (e.g., the second chemical(s)) evaporates, leaving behind the lignin-cellulose solid particles. Alternatively or additionally, in some embodiments, the drying can involve freeze-drying or critical point drying to remove the solution of the slurry, for example, to imbue the resulting bioplastic with a substantially porous structure (e.g., to form an aerogel). Alternatively or additionally, in some embodiments, the drying can involve solvent exchange, for example, to replace the second chemical(s) in the slurry with a different solvent.

In some embodiments, the drying may be performed simultaneously with the shaping, for example, where the slurry is disposed within a mold or cast while it is dried. Alternatively or additionally, the drying may be performed after the shaping, for example, where the slurry is printed using an additive manufacturing setup and the printed slurry then dries in the disposed location. In some embodiments, the bioplastic can be pressed during drying (e.g., when the slurry is retained by an appropriate mold) and/or after drying (e.g., when the solution has been removed from the lignin-cellulose solids), for example, to form a densified structure (e.g., lacking microscale and macroscale pores).

Figures 2A, 2B, 2C, 2D:
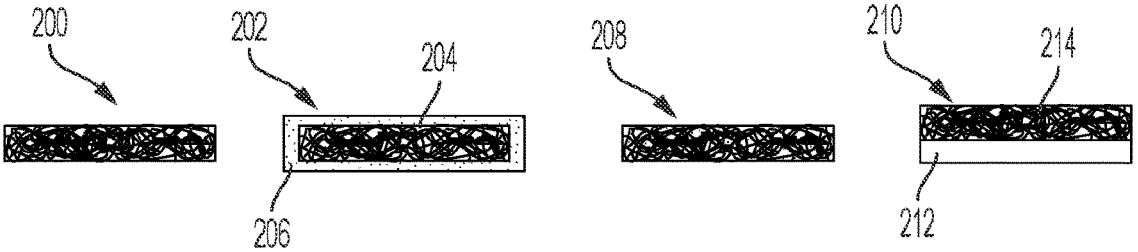
FIG. 2A is a simplified cross-sectional view of an exemplary bioplastic structure, according to one or more embodiments of the disclosed subject matter.
FIG. 2B is a simplified cross-sectional view of another exemplary bioplastic structure including a coating, according to one or more embodiments of the disclosed subject matter.
FIG. 2C is a simplified cross-sectional view of an exemplary bioplastic composite structure including a polymer, according to one or more embodiments of the disclosed subject matter.
FIG. 2D is a simplified cross-sectional view of an exemplary composite structure including a bioplastic coupled to separate material, according to one or more embodiments of the disclosed subject matter.

In some embodiments, the bioplastic resulting from the process of FIG. 1 can be a structure 200 consisting of lignin and cellulose only (or consisting essentially of lignin and cellulose, if impurities not substantially affecting properties of the bioplastic are present, such as concentrations of hemicellulose less than 7.5 wt %), as shown in FIG. 2A. In some embodiments, the bioplastic resulting from the process of FIG. 1 can be a composite structure 202, as shown in FIG. 2B. The composite structure 202 can include an internal lignin-cellulose structure 204 (e.g., consisting or consisting essentially of lignin and cellulose, similar to structure 200 of FIG. 2A) and a coating 206 on one or more external surfaces of the structure 204. For example, the coating can be a protective coating, a paint, a metal film, or any other material capable of being formed on or coupled to an external surface of the structure 204. In some embodiments, the coating 206 can imbue the surface of the structure 204 with chemical and/or mechanical properties different than a body of the structure 204, for example, to provide a different visual appearance (e.g., color), protect the bioplastic from premature degradation, provide fire resistance, or any other purpose.

In some embodiments, the bioplastic resulting from the process of FIG. 1 can be a unitary composite structure 208, as shown in FIG. 2C. Instead of including only lignin and cellulose, the composite structure 208 can further include a polymer, for example, infiltrating or integrated with an internal microstructure formed by the lignin and cellulose of the bioplastic. In some embodiments, the polymer (or precursor(s) thereof) can be added to the lignin-cellulose slurry prior to shaping and drying to form an integrated bioplastic composite. Alternatively or additionally, in some embodiments, the polymer (or precursor(s) thereof) can be combined with the bioplastic after formation, for example, by infiltrating into open pores therein (e.g., by the polymer filling open pores of a bioplastic aerogel).

In some embodiments, the bioplastic resulting from the process of FIG. 1 can be a composite structure 210 with bioplastic 214 (e.g., similar to structure 200 of FIG. 2A or structure 208 of FIG. 2C) coupled to a secondary structure 212 along facing surfaces, as shown in FIG. 2D. The secondary structure 212 can be any other material, such as but not limited to, another bioplastic with a different material composition, a native or modified plant material (e.g., wood), a metal, a concrete, or other structural material. Although the structures of FIGS. 2A-2D are shown with rectangular cross-sections, embodiments of the disclosed subject matter are not limited thereto. Rather, any arbitrary 2-D shape or 3-D shape is possible for the structures, according to one or more contemplated embodiments.

Examples of Wood-Derived Bioplastics

Natural wood has a unique three-dimensional porous structure with multiple channels or lumina formed by longitudinal cells, including vessels (e.g., having a maximum cross-sectional dimension, or diameter, in a plane perpendicular to a length thereof of 40-80 μm, inclusive) and fibers (e.g., having a maximum cross-sectional dimension, or diameter, in a plane perpendicular to a length thereof of 10-30 μm, inclusive) extending in a direction of wood growth. Walls of cells in the natural wood are primarily composed of cellulose (40 wt %~50 wt %), hemicellulose (20 wt %~30 wt %), and lignin (20 wt %~35 wt %), with the three components intertwining with each other to form a strong and rigid wall structure.

The naturally-occurring cellulose in the wood exhibits a hierarchical structure. For example, as shown in FIG. 3A, the natural wood cell 218 has a plurality of cellulose fibers 220 (e.g., microbundles) surrounding and extending substantially parallel to lumen 216. The cellulose fibers 220 can be separated into constituent high-aspect-ratio microfibrils 222 in the form of aggregated three-dimensional networks that provide relatively high surface area. The cellulose microfibrils 222 can be further subdivided into elementary nanofibrils 224, which are composed of 12-36 linear cellulose molecular chains 226. Each cellulose molecular chain 226 is formed of thousands of repeating glucose units connected by strong covalent bonds that are arranged in a highly-ordered crystalline structure. The cellulose molecular chains 226 are held together in a densely-packed arrangement forming the elementary nanofibril 224 by intramolecular hydrogen bonding between functional groups of adjacent molecular chains.

To separate the cellulose microfibrils 222 and/or nanofibrils 224 from the bundles and dissolve the lignin and hemicellulose in the wood cell walls, the wood can be immersed in the first chemical(s). For example, a deep eutectic solvent (DES) can be used as the first chemical(s). DES can include a mixture (e.g., in a molar ratio of 1:1) of choline chloride (ChCl), which is an animal growth promotant that acts as a hydrogen bond acceptor (HBA), and oxalic acid, which a plant-based resource that acts as a hydrogen bond donor (HBD). Referring to FIG. 3B, at an initial stage 300 prior to introduction of any DES, the wood in its native state has an intertwined structure of lignin 304, cellulose 302, and hemicellulose. For ease of illustration, FIG. 3B does not show hemicellulose and otherwise illustrates the chemical structures of lignin and cellulose separately; however, in practical embodiments, hemicellulose would be present and the lignin, cellulose, and hemicellulose would interact with each other during the various stages.

Introduction of DES 312 at stage 306 can efficiently deconstruct the wood by disrupting the hydrogen bonding between cellulose fibers, as shown at 314. Moreover, the rich hydrogen bonding and acidity of the DES 312 allows for rapid dissolution of the native lignin. For example, the native lignin 304 can be converted by DES-induced acidolysis to the structure illustrated at 308, and then DES-induced deprotonation to the structure illustrated at 310. Thus, as a result of the DES exposure at stage 306, the native lignin 304 undergoes cleavage of the β-O-4 ether bond, resulting in lignin 310 dissolved in the DES.

To regenerate the lignin in situ, second chemical(s) are added at stage 316. For example, water as a high polarity solvent can be added to the DES to regenerate the dissolved lignin by interacting with hydrophobic DES through hydrogen bond interaction. This interaction leads to the rapid separation of the dissolved lignin from DES and in situ regeneration on cellulose micro/nanofibrils surface. For example, the water 320 can replace DES interacting with the cellulose fibers, as shown at 314, and can interact with the dissolved lignin 310 to convert it to the structures illustrated at 318 via hydration and deprotonation.

After removal of DES from the solution, the resulting slurry of lignin-cellulose solids in water can be shaped and dried to form the desired lignocellulosic bioplastic. The entanglement between adjacent cellulose microfibrils and nanofibrils via hydrogen bonding, as well as the interaction between the cellulose and lignin solids in the bioplastic, can contribute to the favorable properties exhibited by the bioplastic. Referring to FIG. 3C, the interaction between the regenerated lignin 334 and cellulose micro/nanofibrils 332*a*, 332*b* is shown. The regenerated lignin 334 tightly interacts with the micro/nanofibrils 332*a*, 332*b* containing hydroxyl and oxalic acid-induced carbonyl groups by hydrogen bonding 336 (OH···HO, COO···HO) and van der Waals forces to form strong lignin-cellulose supramolecular complexes, which can impart the lignocellulosic bioplastic 330 with high mechanical strength and excellent multifunctional performance.

The $^{1}H$-$^{13}C$ NMR spectra of in situ regenerated lignin in lignocellulosic bioplastic was measured (FIG. 3E) and compared to milled wood lignin (MWL), as a representative of native lignin (FIG. 3D), in particular, in the aliphatic ($\delta_C/\delta_H$ 50-90/3.0-5.5) and aromatic regions ($\delta_C/\delta_H$ 95-135/6.3-8.0). MWL is composed of phenylpropane monomeric units, which are primarily linked through ether bonds (e.g., β-O-4) and carbon-carbon bonds (e.g., β-β, β-5). The β-O-4 ether bond typically accounts for ~40-65% of the total linkages in lignin. However, in the side-chain region 340, the signals correlating to Aa-s ($\delta_C/\delta_H$ 71.8/4.83) and $A_{\beta\text{-}S}$ ($\delta_C/\delta_H$ 85.9/4.11) disappear in the regenerated lignin after the DES treatment, as shown in FIG. 3E, versus the corresponding region 338 in milled wood, as shown in FIG. 3D. This confirms cleavage of the β-O-4 ether bond, which causes the lignin to dissolve in DES.

This process occurs by protonation of the lignin $C_\alpha$—OH group in acidic DES, followed by dehydration to form a $C_\alpha$ cation intermediate. The $C_\alpha$ cation is then transformed to the CB cation via an enol ether intermediate or direct hydride shift. Subsequent hydration and deprotonation then leads to the cleavage of the β-O-4 bond and the formation of a Hibbert's ketone and phenol hydroxyl group. The formation of these ketone and phenol groups in the regenerated lignin facilitates the crosslinking between the lignin and cellulose micro/nanofibrils via hydrogen bonding interactions, enabling the structural assembly and highly entangled network found in the lignocellulosic bioplastic. Additionally, the C—C signals (e.g., $C_\beta$, $B_\beta$) of the regenerated lignin still exist, which suggests that the C—C bonds of the non-polar phenylpropanes in the regenerated lignin remain stable after DES treatment.

Although the above description of FIGS. 3A-3F has focused on wood as the biomass and DES as the first chemical(s), embodiments of the disclosed subject matter are not limited to these specific chemicals. Rather other biomass materials containing lignin and cellulose besides wood and/or other first chemical(s) besides DES can be used to form the bioplastic, for example, as otherwise described herein.

Fabrication and Use of Bioplastics

FIG. 4 illustrates an exemplary method 400 for forming a lignocellulosic bioplastic, or a bioplastic composite, from a biomass and subsequent use thereof. The method 400 can initiate a process block 402, where a biomass is provided. The biomass can be any type of plant material that has a microstructure formed by intertwined lignin, hemicellulose, and cellulose (e.g., in the form of microfibrils and/or nanofibrils). In some embodiments, the biomass can be a mechanically-processed or waste portion of a plant material, such as but not limited to wood chips, wood powder, sawdust, bagasse, wheat straw, coconut shell, haulm, or corn stalk.

The method 400 can proceed to process block 404, where the lignin and hemicellulose in the biomass is dissolved thereby fibrillating the cellulose of the biomass. For example, the cellulose in the biomass can be retained in bundles (e.g., having a diameter of 50-100 μm), and the fibrillating can be effective to release the constituent cellulose microfibrils and/or nanofibrils (e.g., having a diameter of 10-300 nm) from the bundles. In some embodiments, the lignin and hemicellulose can be dissolved by immersing the biomass in, or otherwise exposing the biomass to, one or more first chemicals. For example, the immersion of the biomass in the one or more first chemicals may be performed at an elevated temperature (e.g., by heating the first chemical(s) at a temperature of at least 90° C., such as 110° C.) for a predetermined period of time (e.g., in a range of 0.5-4 hours, such as 2 hours). In some embodiments, the first chemical(s) with the biomass therein can be mechanically agitated (e.g., mixing or stirring) upon immersion of the biomass into the first chemical(s), periodically during the immersion, continuously during the immersion, or any combination of the foregoing.

In some embodiments, the one or more first chemicals can comprise an alkali solution, an acid solution, an organic solvent, a deep eutectic solvent (DES), or any combination of the foregoing. In some embodiments, the alkali solution can comprise, for example, $X/Na_2SO_3$, $X/Na_2SO_4$, $X/Na_2S$, X/urea, $NaHSO_3+SO_2+H_2O$, $NaHSO_3$, $NaHSO_3+Na_2SO_3$, $X+Na_2SO_3$, $Na_2SO_3$, X+AQ, $X/Na_2S$+AQ, $NaHSO_3+SO_2+H_2O$+AQ, $X+Na_2SO_3$+AQ, $NH_3{\cdot}H_2O$, $NaHSO_3$+AQ, $NaHSO_3+Na_2SO_3$+AQ, $Na_2SO_3$+AQ, $X+Na_2S+Na_2S$, $Na_2SO_3+X+CH_3OH$+AQ, or any combination of the foregoing, where X=NaOH, LiOH, or KOH and AQ=anthraquinone ($C_{14}H_8O_2$). In some embodiments, the acid solution can comprise, for example, $CH_2O_2$, $CH_3COOH$, $CH_3OH+CH_2O_2$, $NaClO_2+CH_3COOH$, $CH_3COOH+ClO_2$, or any combination of the foregoing. In some embodiments, the organic solvent can comprise, for example, $CH_3OH$, $C_2H_5OH$, $C_4H_9OH$, $C_2H_5OH$+NaOH, $C_5H_8O_2$, $C_3H_6O$, or any combination of the foregoing. In some embodiments, the DES can comprise ChCl+Oxalic acid, ChCl+lactic acid, ChCl+glycerol, ChCl+urea, betaine+lactic acid, $ZnCl_2$+urea, glycerol+$AlCl_3{\cdot}6H_2O$, or any combination of the foregoing.

The method 400 can proceed to process block 406, where at least the dissolved lignin can be in situ regenerated (e.g., precipitated) from the first chemical(s). For example, one or more second chemicals can be added to the combination of biomass and first chemical(s). For example, the in situ regeneration process may be performed at an elevated temperature (e.g., by heating the mixture of first and second chemicals at a temperature less than 100° C.) for a predetermined period of time (e.g., in a range of 0.5-4 hours, such as 2 hours). In some embodiments, the mixture of deconstituted biomass, first chemical(s), and second chemical(s) can be mechanically agitated (e.g., mixing or stirring) upon addition of the second chemical(s) into the first chemical(s), periodically after addition of the second chemical(s), continuously after the addition of the second chemical(s), or any combination of the foregoing.

In some embodiments, the one or more second chemicals can comprise a neutralizing agent with respect to the first chemical(s). In some embodiments, for example, when the first chemical(s) comprises an alkali solution, the second chemical(s) can comprise an acid. For example, when the first chemical(s) include NaOH or $NH_3{\cdot}H_2O$, the second chemical(s) can include HCl, $H_2SO_4$, or formic acid. In some embodiments, for example, when the first chemical(s) comprises an acidic solution, the second chemical(s) can comprise a base, such as NaOH, KOH, LiOH, or any combination thereof. Alternatively or additionally, in some embodiments, for example, when the first chemical(s) include DES, the one or more second chemicals can comprise a high polarity solvent, such as distilled water.

In some embodiments, as the lignin evolves (e.g., resolidifies) out of the first chemical(s), it can deposit on surfaces of the fibrillated cellulose and form hydrogen bonds between adjacent cellulose microfibrils and/or nanofibrils in solution. In some embodiments, the hemicellulose may remain dissolved in the first chemical(s) even after the regeneration of lignin. In some embodiments, the exposure to the first chemical(s) can modify a chemical structure of the lignin and/or the cellulose. For example, when the first chemical(s) includes DES, the regenerated lignin can have β-O-4 ether bonds cleaved as compared to native lignin, and/or hydroxyl groups of the regenerated lignin can be more phenolic than that of native lignin. Alternatively or additionally, the DES can esterify the cellulose, thereby providing COO functional groups thereof with a negative charge.

Alternatively, in some embodiments, the lignin can be in situ regenerated without addition of any second chemical(s). In such embodiments, in situ regeneration can be achieved, for example, by partially or fully evaporating the first chemical(s). For example, when the first chemical(s) include an organic solvent such as formic acid, methanol, or ethanol, the lignin can be regenerated by evaporating the organic solvent.

The method 400 can proceed to process block 408, where the cellulose microfibrils and/or nanofibrils and the regenerated lignin solids can be isolated in solution to form a slurry. For example, the isolation of the lignin-cellulose solids can include removing all of the first chemical(s) and optionally at least some of the second chemical(s). In some embodiments, the isolation of the lignin-cellulose solids can be via filtering (e.g., vacuum filtering, such as by using a sand core or Buchner funnel at a vacuum pressure of 0.1-10 MPa) or via any other solid separation technique (e.g., centrifugation or hydrocycloning). Alternatively, in some embodiments, the first chemical(s) can be removed by evaporation or solvent exchange.

In some embodiments, after the isolation of the lignin-cellulose solids, the resulting slurry can retain at least 90% of the lignin (e.g., potentially modified) that was originally in the biomass prior to process block 404. Additionally, in some embodiments, the resulting slurry can retain less than or equal to 10% of the hemicellulose that was originally in the biomass prior to process block 404. In some embodiments, the solid content of the slurry can be tailored by adding solution (e.g., second chemical(s)) to or removing solution (e.g., second chemical(s)) from the slurry. For example, the content of lignin-cellulose solids in the slurry can be in a range of 5-20 wt %.

The method 400 can proceed to decision block 412, where it is determined if optional recycling of chemicals is desired. If chemical recycling is desired, the method 400 can proceed to process block 414, where the solution removed from the slurry at process block 408 is further processed to separate first chemical(s) from second chemical(s), for example, by distillation, evaporation, and/or filtration. The method 400 can then proceed to process block 416, where the segregated first chemical(s) can be reused to dissolve lignin in another biomass (e.g., at process block 404) and/or the segregated second chemical(s) can be reused to regenerate lignin from the first chemical(s) (e.g., at process block 406).

The method 400 can proceed to decision block 418, where it is determined if optional materials should be incorporated within the bioplastic (e.g., to form a bioplastic composite or hybrid). If additional materials are desired, the method 400 can proceed to process block 420, where such additional materials are incorporated into the lignin-cellulose slurry. The additional materials can imbue the subsequent lignocellulosic structure with properties not otherwise available to the lignin-cellulose alone, for example, enhanced hydrophobicity, chemical resistance, optical transmittance, fire resistance, etc. For example, in some embodiments, the additional material can be a polymer (or precursor thereof), such as a natural resin or rosin, polymethyl methacrylate (PMMA), polyvinyl alcohol (PVA), polydimethylsiloxane (PDMS), polyethylene terephthalate (PET), polycarbonate (PC), polyethylene glycol (PEO), polyamide (PA), polyethylene terephthalate (PET), polybutylene terephthalate (PBT), polytrimethylene terephthalate (PTT), polyacrylonitrile (PAN), polycaprolactam (Nylon 6), poly(m-phenylene isophthalamide) (PMIA), poly(p-phenylene terephthalamide) (PPTA), polyurethane (PU), polycarbonate (PC), polypropylene (PP), high-density polyethylene (HDPE), polystyrene (PS), polycaprolactone (PCL), polybutylene succinate (PBS), polyglycolide (PGA), poly(methyl methacrylate (PMMA), acrylonitrile butadiene styrene (ABS), or polymethysilane (PMS). Alternatively or additionally, in some embodiments, process block 420 can involve addition of non-native particles or materials into the slurry, such as nanoparticles (e.g., $SiO_2$ or BN nanoparticles).

After process block 420 or if no material addition is desired at decision block 418, the method 400 can proceed to process block 422, where the slurry can be used to form a solid bioplastic (or composite) by shaping and/or drying. For example, the drying can remove the solution (e.g., second chemical(s)) from the slurry, leaving behind the lignin-cellulose solids to form the solid bioplastic. In some embodiments, the shaping can occur prior to, during, or after the drying. For example, the shaping can involve casting, calendering (e.g., processing the paste-like slurry into a film or sheet), pressing (e.g., by a hot press), depositing (e.g., by 3D printing), or any other manner of plastic forming (e.g., injection molding, blow molding, extrusion, etc.). In some embodiments, the drying of process block 422 can comprise freeze drying, critical point drying, and/or solvent exchange (e.g., by replacing water with an alcohol). In such embodiments, the bioplastic resulting from the drying may be a porous solid, such as an aerogel.

The method 400 can proceed to optional process block 424, where the solid bioplastic can be further processed. In some embodiments, the further processing of process block 424 can include pressing of the bioplastic solid to yield a densified structure. For example, the pressing can be a temperature of at least 15° C., for example, in a range of 60-150° C. and/or at pressure of 0.5-10 MPa. Alternatively or additionally, in some embodiments, the further processing of process block 424 can include coating one or more external surfaces of the bioplastic solid, for example, with a protective layer or paint. Alternatively or additionally, in some embodiments, the further processing of process block 424 can include machining or other mechanical modification, for example, by removing portions of the bioplastic solid to form a desired shape without molding. Alternatively or additionally, in some embodiments, the further processing of process block 424 can include coupling the bioplastic solid to one or more other structures, for example, another bioplastic solid (e.g., with the same or different material composition), a plant material (e.g., in its native state or otherwise processed), or a building or structural material (e.g., engineered wood, plastic, metal, or concrete).

The method 400 can proceed to process block 426, where the solid bioplastic can be used. The solid bioplastic can be used in any application where conventional plastics have been or will be used, as well as other applications enabled by the improved mechanical properties of bioplastic (e.g., having a tensile strength greater than many conventional plastics and higher temperature for onset of thermal degradation than many conventional plastics).

The method 400 can proceed to decision block 428, where it is determined if the bioplastic should be recycled after its useful life. If recycling is desired, the method 400 can proceed to process block 430, where the bioplastic is immersed in solution to reform a slurry (e.g., for reuse at process block 422). For example, the bioplastic solid can optionally be mechanically processed (e.g., milled, diced, cut, etc.) into particles. The bioplastic solid can then be immersed in the second chemical(s) (e.g., water), with or without mechanical agitation (e.g., mixing), in order to resuspend the lignin-cellulose solids in solution. If recycling is not desired, the method 400 can proceed to process block 432, where the bioplastic can be biodegraded or composted. For example, the bioplastic solid can be left exposed to the elements (e.g., sun, wind, rain) or buried in soil with microorganisms, which digest cellulose and lignin macromolecules of the bioplastic, such that the bioplastic completely degrades on the order of months.

Although some of blocks 402-432 of method 400 have been described as being performed once, in some embodiments, multiple repetitions of a particular process block may be employed before proceeding to the next decision block or process block. In addition, although blocks 402-432 of method 400 have been separately illustrated and described, in some embodiments, process blocks may be combined and performed together (simultaneously or sequentially). Moreover, although FIG. 4 illustrates a particular order for blocks 402-432, embodiments of the disclosed subject matter are not limited thereto. Indeed, in certain embodiments, the blocks may occur in a different order than illustrated or simultaneously with other blocks.

Referring to FIG. 5A, an exemplary system 500 for processing a biomass to form a slurry of lignin-cellulose solids in solution is shown. The system can include an intake and mixing chamber 506, where biomass feed 504 is combined with first chemical(s) (e.g., DES) from feed line 502. The mixing chamber 506 can include one or more heaters (not shown) so as to maintain an elevated temperature therein (e.g., ~110° C.). In some embodiments, the chamber 506 can include active mixing components, such as a stirrer (not shown), and/or passive components (e.g., baffles) to encourage mixing between the biomass and first chemical(s). After sufficient immersion in the first chemical(s) to effect lignin dissolution and cellulose fibrillation (e.g., 0.5-4 hours), the contents can be transferred via conduit 508 to regeneration chamber 510.

In regeneration chamber 510, second chemical(s) (e.g., water) can be added to the contents via feed line 512, so as to cause lignin dissolved in the first chemical(s) to in situ regenerate and deposit on the fibrillated cellulose within the chamber 510. The regeneration chamber 510 can include one or more heaters (not shown) so as to maintain an elevated temperature therein (e.g., <100° C.). In some embodiments, the chamber 510 can include active mixing components, such as a stirrer (not shown), and/or passive components (e.g., baffles) to encourage mixing between the biomass and first chemical(s). After sufficient immersion in the second chemical(s) to effect lignin regeneration (e.g., 0.5-4 hours), the contents can be transferred via conduit 514 to slurry separation chamber 516.

In slurry separation chamber 516, the lignin-cellulose solids can be isolated from the first chemical(s). For example, the separation chamber 516 can include a filter 518, which allows the first chemical(s) and at least some of the second chemical(s) to pass therethrough into the permeate 524 while keeping the lignin-cellulose solids in the retentate 522. Further second chemical(s) can be added to the contents via feed line 520, for example, to wash any first chemical residue from the solids in the retentate 522 and/or to tune a solid content of the slurry. The slurry of lignin-cellulose solids in solution can be transferred from chamber 516 via conduit 528 to a reservoir 530 for later use in forming a solid bioplastic.

Meanwhile, the first and second chemicals in the permeate 524 can be transferred from chamber 516 to chemical separation chamber 532 via conduit 526. The chemical separation chamber 532 can include one or more heaters (not shown). In some embodiments, the heaters maintain an elevated temperature (e.g., ~100° C.) of the chamber 532, such that the second chemical(s) evaporate while the first chemical(s) are retained in the chamber 532. The evaporated second chemical(s) can be captured and transferred via conduit 536 to a condensing chamber 538, where the second chemical(s) are returned to liquid form and stored therein for subsequent reuse. For example, recycle supply line 540 can direct the second chemical(s) to feed lines 512 and/or 520 for reuse. Alternatively or additionally, the liquid first chemical(s) retained in chamber 532 can be directed via recycle supply line 534 to feed line 502 for reuse.

In FIG. 5A, pumps, valves, and a control system for coordinating timing and flow between different components and operation thereof are not shown for clarity of illustration. However, it should be appreciated that practical embodiments of system 500 can include such pumps, valves, and control system, among other non-illustrated components.

Referring to FIG. 5B, an exemplary molding system for forming a lignin-cellulosic bioplastic from a slurry is shown. In an initial slurry injection stage 550, mold halves 552*a*, 552*b* can delineate an internal open volume 556 that defines a shape of the ultimate bioplastic. The slurry can be injected via inlet 554 into volume 556. In some embodiments, at the solidification stage 560, the mold halves 552*a*, 552*b* can be heated to cause drying of the slurry 562 within the volume 556. Alternatively or additionally, the slurry can include a solvent that normally evaporates at room temperature. Once the slurry has hardened into a solid bioplastic structure 572, the mold halves 552*a*, 552*b* can be separated and the bioplastic removed therefrom, as shown in the release stage 570. Although FIG. 5B illustrates a molding volume 556 and resulting bioplastic 572 with rectangular cross-sections, embodiments of the disclosed subject matter are not limited thereto. Rather, any arbitrary 2-D shape or 3-D shape is possible for the molding volume and bioplastic, according to one or more contemplated embodiments.

Referring to FIG. 5C, an exemplary pressing system 580 for forming a densified bioplastic is shown. In some embodiments, the pressing system can be combined with one or more molds, e.g., in a manner similar to FIG. 5B, for example, to simultaneously shape, solidify, and densify. Alternatively, in the illustrated example, the pressing system 580 can be constructed to press, compact, or densify a previously-formed solid bioplastic structure 584. The pressing system 580 can include an upper platen 582*a* and a lower platen 582*b*.

Relative motion between the platens 582*a*, 582*b* results in the desired compression of bioplastic to produce the densified bioplastic. For example, upper platen 582*a* may move toward lower platen 582*b*, which remains stationary and supports the wood bioplastic 584 thereon, in order to impart a compression force to the bioplastic. Alternatively, the lower platen 582*b* can move toward a stationary upper platen 582*a*, or both platens 582*a*, 582*b* can move toward each other to impart the compression force. In some embodiments, during the compression, one or both platens 582*a*, 582*b* can be heated so as to raise a temperature of the bioplastic above room temperature (e.g., 60-150° C.). Alternatively or additionally, the platens 582*a*, 582*b* may be unheated but a separate heating mechanism may be provided or an environment containing the pressing system 580 can be heated in order to raise a temperature of the bioplastic 584.

Referring to FIG. 5D, an exemplary additive manufacturing system 590 (e.g., 3D printing system) is shown. The additive manufacturing system 590 can include a printing head 596 (e.g., supporting or otherwise fluidically connected to a supply of slurry) with a nozzle 598 that can dispense slurry 594 on support 592 in arbitrary shapes or configurations. In some embodiments, the support 592 can be movable in one dimension, two dimensions, or three dimensions. Alternatively or additionally, the printing head 596 can be in one dimension, two dimensions, or three dimensions. Alternatively or additionally, one of the support 592 and the printing head 596 can be substantially fixed in position, while the other moves in one or more dimensions. In some embodiments, the support 592 can be heated, for example, to effect, or at least encourage, drying of deposited slurry 594.

Fabricated Examples and Experimental Results

A deep eutectic solvent (DES) was used to efficiently deconstruct wood by disrupting the hydrogen bonding between cellulose fibers as well as dissolving lignin and hemicellulose. In some fabricated examples, the DES comprised a mixture of choline chloride (ChCl), which served as a hydrogen bond acceptor, and oxalic acid ($C_2H_2O_4$), which served as a hydrogen bond donor. The solution was prepared by heating ChCl and oxalic acid (e.g., in a 1:1 molar ratio) at 80° C. to form a transparent solution. The DES mixture was then cooled to room temperature (e.g., ~20° C.) for subsequent use. For the DES used in lignin dissolution, choline chloride and oxalic acid form hydrogen bonding interactions (OH···Cl) that reduce the ability of the compounds to crystallize and keeps DES in a stable liquid state.

This configuration also facilitates the delocalization of the hydrogen protons in oxalic acid, which increases the acidity of the DES, thus improving the treatment efficiency for wood.

For the biomass, poplar wood powder was selected. The biomass and DES were mixed at a mass ratio of 1:15, and the mixture was heated to a temperature of 110° C. (e.g., for 2 hours) to dissolve the lignin and hemicellulose in the biomass and fibrillate the cellulose. Since lignin is hydrophobic, lignin can be rapidly regenerated from the DES by simply adding water to the solution of dissolved lignin and fibrillated cellulose. Thus, after the dissolution, distilled water was added to the solution in a ratio of 1:10 (v/v water: solution) and stirred for another 2 hours to provide in situ lignin regeneration. The resulting cellulose and lignin solids were isolated from the DES (e.g., by filtering) and washed using additional distilled water to remove residual DES. The DES was recycled by heating the filtered liquid to remove water. Ultrasonic processing may be used to encourage uniform dispersion of lignin-cellulose solids within the solution. After ultrasonic processing (800 W), the mixture was vacuum-filtered for different amounts of time to obtain different solid contents of the resulting cellulose-lignin slurry (e.g., 5-20 wt %, such as ~15 wt % solid content) and corresponding viscosities, as shown in FIG. 6B.

With this slurry, lignocellulosic bioplastic films were formed by a simple casting process. For example, the slurry was spread on a hydrophobic substrate (e.g., to aid in subsequent film removal) by a glass rod. After evaporation of water from the slurry at room temperature, lignocellulosic bioplastic films were produced having sizes of, e.g., 100 cm×15 cm×0.1 cm. The resulting lignocellulosic bioplastic exhibits excellent mechanical robustness and flexibility. It can be easily rolled without breaking due to the entangled cellulose fibrils and regenerated lignin binder. Other formation or shaping techniques can be used to provide a solid bioplastic structure from the cellulose-lignin slurry. For example, FIG. 6B shows use of the slurry to form an arbitrary three-dimensional shape using an additive manufacturing (e.g., 3D printing) approach.

FIG. 6A compares the chemical composition of a fabricated bioplastic film to that of the original biomass (e.g., wood powder). As is evident from FIG. 6A, the above-noted bioplastic fabrication process employing in situ lignin regeneration is able to retain substantially all of the cellulose (e.g., before bioplastic formation: 46.0%±1.0%; after bioplastic formation: 42.0%±2.1%) and substantially all of the lignin (e.g., before bioplastic formation: 19.1%±0.39%; after bioplastic formation: 17.2%±0.3%). However, a substantial amount of the hemicellulose is removed by the bioplastic fabrication process (e.g., before bioplastic formation: 30.0%±0.89%; after bioplastic formation: 6.1%±1.8%).

As shown in FIG. 7A, the solid lignocellulosic bioplastic exhibits a homogeneous and dense structure with a relatively flat surface. As shown in FIG. 7B, the cellulose of the starting biomass has been defibrillated into micro/nanofibrils that are surrounded by lignin, which functions as a natural and biodegradable binder that tightly holds the micro/nanofibrils together, enhancing the interactions between them. A dense laminated structure is formed in the lignocellulosic bioplastic, in which each layer is made of the intertwined, lignin-adhered cellulose fibrils, as shown in FIGS. 7C-7D. This structure is substantially different from the loosely-packed macro-sized fibers or bundles (50-100 μm) of the native wood powder starting material. At higher resolution, transmission electron microscopy (TEM) images show the diameters of the fibrillated cellulose micro/nanofibrils of the lignocellulosic bioplastic ranged from 10 to 300 nm (FIGS. 7E and 7G). As shown in FIGS. 7F and 7H, the cellulose micro/nanofibrils in the bioplastic also had regenerated lignin deposited thereon. The fibrillated cellulose is densely functionalized with hydroxyl groups, which strengthens the absorption of lignin by hydrogen bonding, thus facilitating the structural self-assembly of the regenerated lignin on the surface of the micro/nanofibrils. Compared to the natural wood powder, small angle X-ray scattering (SAXS) verified the more isotropic structure of the lignocellulosic bioplastic.

In another fabricated example, densified bioplastic films were fabricated by combining casting with hot press. The pressing can reduce a thickness of the materials, thereby increasing its density as well as removing any voids between lignin and cellulose. The pressing can be at a pressure between 0.5 MPa and 10 MPa, e.g., 5 MPa. Alternatively or additionally, the pressing may be performed at an elevated temperature (e.g., 60-150° C., such as 130° C.). During in-situ lignin treatment, cellulose is defibrillated into micro/nanofibrils and surrounded by lignin, which functions as a natural and biodegradable glue to tightly hold the cellulose micro/nanofibrils together and enhance fibril-interactions. After hot pressing, a dense layered structure is formed in the bioplastic, with each layer comprising lignin-glued intertwined cellulose fibrils with nanoscale entanglement. In the fabricated example, a lignocellulosic bioplastic was pressed at 130° C. for 3 hours. The resulting bioplastic sample had dimensions of approximately 50 mm by 5 mm. The tensile properties were then measured by stretching at a constant test speed of 5 mm/min until fracture. A cellulose film of similar dimensions was also tested from comparison. As shown in FIG. 8A, the densified bioplastic demonstrated excellent mechanical properties with a high tensile strength of ~128 MPa and toughness of ~2.8 $MJ \cdot m^3$, which values are about 8-times higher than cellulose film (e.g., tensile strength of ~18 MPa and toughness of ~0.35 $MJ \cdot m^3$). Without being bound by any particular theory, the high tensile strength is believed to be a product of the entanglement of cellulose micro/nanofibrils and lignin-induced adhesion.

Fourier transform infrared (FTIR) spectroscopy was conducted on the native wood powder, pure cellulose (e.g., by removing lignin and hemicellulose from the native wood powder), and the lignocellulosic bioplastic. As shown in FIG. 8B, the lignocellulosic bioplastic features absorption peaks at 1602, 1508, and 1456 $cm^{-1}$ in the FTIR spectrum, which are attributed to the vibrations of the aromatic skeleton of lignin. Additionally, these peaks do not appear in the pure cellulose control, suggesting the bioplastic retains lignin. A new absorption peak in the bioplastic also appears at 1726 $cm^{-1}$, which corresponds to the C═O stretching of a carbonyl group, thus indicating the partial esterification of the cellulose hydroxyl groups by oxalic acid during the DES treatment.

Optical properties of the cellulose and the lignocellulosic bioplastic were further characterized, as shown in FIGS. 8C-8D. The abundant carbonyl and phenolic hydroxyl groups in the regenerated lignin allow the lignocellulosic bioplastic to almost completely absorb UV light from 200-400 nm in the UV/vis spectrum, suggesting its superior UV-screening ability.

Due to the introduced carbonyl groups on cellulose, the lignocellulosic bioplastic has a more negative charge (Zeta potential: −28.2 mV) than the natural wood powder and pure cellulose samples in neutral aqueous solution (pH=7), as shown in FIG. 8E. The repulsive force of the negatively-charged functional groups of the lignocellulosic bioplastic contributes to the excellent dispersion of its slurry, enabling good processability via casting, printing, or other formation techniques. Meanwhile, X-ray diffraction (XRD) patterns of the wood powder, cellulose, and lignocellulosic bioplastic exhibited similar diffraction peaks (2θ=14.6°, 16.6°, and 22.6°, as shown in FIG. 8F) indicative of the cellulose I crystalline structure. This further confirms that after the in situ lignin regeneration treatment the cellulose in the bioplastic retains its crystalline structure. Additionally, the crystallinity index (CrI) of the lignocellulosic bioplastic was ~40.6±4.3%, showing a 9.4% enhancement compared to the raw wood powder (~31.2±3.2%), which can be attributed to the removal of hemicellulose and amorphous cellulose by the DES processing.

The regenerated lignin exhibits an amphiphilic character due to the existence of both polar hydrophilic side chains (e.g., phenolic hydroxyl groups) and non-polar hydrophobic backbone (e.g., hydrocarbon groups, phenylpropane). Such amphiphilic character is attractive for achieving both good mechanical strength and water stability, as the polar hydrophilic side chains can crosslink with the cellulose micro/nanofibrils to provide mechanical strength, whereas the non-polar hydrophobic backbone can prevent water permeation. Thus, fabricated bioplastic films exhibited higher contact-angle values (e.g.,) ~90.0° than that of pure cellulose film (e.g., ~78.7°), and demonstrated a tendency to repel water from a surface of the bioplastic. After 10 minutes of application to the surface, a water droplet gradually spreads out and adheres to the cellulose film surface (e.g., contact angle of) ~28.2°, whereas the shape of the droplet on the bioplastic remains relatively steady (e.g., contact angle of) ~71.8°. Even after 90 minutes, the water droplet was not completely absorbed to the surface of bioplastic suggesting excellent water/wet stability. The bioplastic also exhibited a thermal degradation temperature of 357° C., further demonstrating the material's excellent thermal stability.

Cellulose and bioplastic films were subjected to a thirty-day-long stability test in a humid/water vapor environment. Over time during the test, the cellulose film disintegrated into microfibers, while the bioplastic retained its original shape without any fractures, suggesting good stability in humid/water environments. Despite the excellent stability when exposed to water and humidity, the bioplastic is still readily biodegradable, for example, by exposing to microorganisms (e.g., bacteria and fungi) in soil or via compositing. The microorganisms can directly attack and digest the cellulose and lignin macromolecules of bioplastic. When placed in moist soil for an extended period of time (e.g., on the order of weeks or months), the bioplastic becomes increasingly fragile. For example, the bioplastic was completely degraded into natural compost substances after being buried in moist soil for three months, which provides additional nourishment (e.g., water, $CO_2$ and organics) for plant growth. In another example, the bioplastic was placed in grass and exposed to the elements (e.g., sun, wind, rain, etc.). After several months, the bioplastic had completely degraded from its original structure.

Alternatively, the bioplastic can be recycled into a slurry for reuse. For example, the bioplastic can be disassembled and converted into a homogeneous cellulose-lignin slurry by mechanical disintegration (e.g., cutting and/or agitation, such as mechanical stirring) in aqueous solution without the use of any chemicals. The slurry can then be cast or otherwise reformed into another strong and hydro-stable bioplastic.

In addition, one or more chemicals employed in the bioplastic fabrication process can be recovered for reuse in subsequent processing of other biomasses. For example, the DES used in the lignin dissolution can be collected in the filtrate after the in situ regeneration stage. Any water contained in the filtrate (e.g., from washing the lignin-cellulose solids) can be evaporated, thereby leaving behind the DES for reuse. Even after recycling, the DES maintains excellent reaction efficiency in terms of deconstructing the lignocellulosic starting material. For example, after reusing the DES five times, the dissolved native lignin content was ~14.25%, decreased by ~3% compared to when pristine DES was used (~17.45%).

Additional Examples of the Disclosed Technology

In view of the above described examples of the disclosed subject matter, this application discloses the additional examples in the clauses enumerated below. It should be noted that one feature of a clause in isolation, or more than one feature of the clause taken in combination, and, optionally, in combination with one or more features of one or more further clauses are further examples also falling within the disclosure of this application.

Clause 1. A method comprising:

(a) dissolving lignin in a biomass comprising an intertwined structure of lignin, hemicellulose, and cellulose, such that the cellulose is fibrillated;

(b) after (a), in situ regenerating the lignin such that the regenerated lignin is deposited on and forms hydrogen bonds between the fibrillated cellulose, so as to form a slurry of lignin-cellulose solids in solution; and (c) after (b), drying the slurry to form a solid lignocellulosic bioplastic.

Clause 2. The method of any clause or example herein, in particular, Clause 1, wherein (a) comprises subjecting the biomass to a first chemical treatment by immersing the biomass in a first solution with one or more first chemicals, the first chemical treatment being effective to dissolve the lignin and to fibrillate the cellulose into microfibrils, nanofibrils, or both microfibrils and nanofibrils.

Clause 3. The method of any clause or example herein, in particular, any one of Clauses 1-2, wherein (b) comprises:

(b1) after (a), adding one or more second chemicals to the first solution, such that the lignin is regenerated in situ from the one or more first chemicals, so as to form the lignin-cellulose solids within the first solution; and (b2) after (b1), removing at least the one or more first chemicals from the first solution, so as to form a lignin-cellulose slurry.

Clause 4. The method of any clause or example herein, in particular, any one of Clauses 1-3, further comprising:

after (b) and prior to (c), depositing the slurry in a mold or cast, wherein the mold or cast defines a shape of the lignocellulosic bioplastic after (c).

Clause 5. The method of any clause or example herein, in particular, any one of Clauses 1-4, wherein:

(c) comprises pressing the slurry; or the method further comprises, after (c), pressing the solid lignocellulosic bioplastic to form a densified bioplastic.

Clause 6. The method of any clause or example herein, in particular, any one of Clauses 1-5, wherein:

a temperature of the pressing is in a range of 15° C. to 150° C., inclusive;

a pressure of the pressing is in a range of 0.5 MPa to 10 MPa, inclusive; or both of the above.

Clause 7. The method of any clause or example herein, in particular, any one of Clauses 1-6, further comprising:

after (b) and prior to (c), depositing the slurry using a printhead or additive manufacturing nozzle, wherein locations of the depositing define a shape of the lignocellulosic bioplastic after (c).

Clause 8. The method of any clause or example herein, in particular, any one of Clauses 1-7, wherein (c) comprises freeze drying or critical point drying.

Clause 9. The method of any clause or example herein, in particular, any one of Clauses 1-8, wherein, after (c), the bioplastic is formed as an aerogel.

Clause 10. The method of any clause or example herein, in particular, any one of Clauses 1-9, wherein (c) comprises exchanging a first solvent of the solution with a different second solvent.

Clause 11. The method of any clause or example herein, in particular, Clause 10, wherein the first solvent comprises water and the second solvent comprises an alcohol.

Clause 12. The method of any clause or example herein, in particular, any one of Clauses 1-11, further comprising:

prior to (c), adding a polymer or a precursor thereof to the solution, wherein, after (c), the solid bioplastic is a hybrid structure formed by a combination of lignin-cellulose solids and the polymer.

Clause 13. The method of any clause or example herein, in particular, Clause 12, wherein the polymer comprises a natural resin or rosin, polymethyl methacrylate (PMMA), polyvinyl alcohol (PVA), polydimethylsiloxane (PDMS), polyethylene terephthalate (PET), polycarbonate (PC), polyethylene glycol (PEO), polyamide (PA), polyethylene terephthalate (PET), polybutylene terephthalate (PBT), polytrimethylene terephthalate (PTT), polyacrylonitrile (PAN), polycaprolactam (Nylon 6), poly(m-phenylene isophthalamide) (PMIA), poly(p-phenylene terephthalamide) (PPTA), polyurethane (PU), polycarbonate (PC), polypropylene (PP), high-density polyethylene (HDPE), polystyrene (PS), polycaprolactone (PCL), polybutylene succinate PBS), polyglycolide (PGA), poly(methyl methacrylate (PMMA), acrylonitrile butadiene styrene (ABS), polymethysilane (PMS), or any combination of the foregoing.

Clause 14. The method of any clause or example herein, in particular, any one of Clauses 1-13, wherein after (b) and prior to (c), a content of lignin-cellulose solids in the slurry is in a range of 5 wt % to 20 wt %, inclusive.

Clause 15. The method of any clause or example herein, in particular, any one of Clauses 1-14, wherein the biomass comprises a portion of plant material.

Clause 16. The method of any clause or example herein, in particular, Clause 15, wherein the plant material comprises wood, bamboo, grass, hemp, or reed.

Clause 17. The method of any clause or example herein, in particular, any one of Clauses 15-16, wherein the portion is a mechanically-processed or waste portion of the plant material.

Clause 18. The method of any clause or example herein, in particular, Clause 17, wherein the waste portion comprises a wood chip, wood powder, sawdust, bagasse, wheat straw, coconut shell, haulm, or corn stalk.

Clause 19. The method of any clause or example herein, in particular, any one of Clauses 1-18, wherein, after (a), the lignin in the slurry has β-O-4 ether bonds cleaved as compared to native lignin in the biomass prior to (a).

Clause 20. The method of any clause or example herein, in particular, any one of Clauses 1-19, wherein, after (a), hydroxyl groups of the lignin are more phenolic than before (a).

Clause 21. The method of any clause or example herein, in particular, any one of Clauses 1-20, wherein, after (a), a-COO functional group of the cellulose has a negative charge.

Clause 22. The method of any clause or example herein, in particular, any one of Clauses 1-21, wherein:

prior to (a), the intertwined structure of the biomass is comprised of microbundles having a cross-sectional dimension of at least 50 μm; and/or after (a), the fibrillated cellulose is in a form of microfibrils or nanofibrils having a cross-sectional dimension less than or equal to 300 nm.

Clause 23. The method of any clause or example herein, in particular, any one of Clauses 3-22, wherein the one or more first chemicals comprises an alkali solution.

Clause 24. The method of any clause or example herein, in particular, Clause 23, wherein the alkali solution comprises sodium hydroxide (NaOH), lithium hydroxide (LiOH), potassium hydroxide (KOH), sodium sulfite ($Na_2SO_3$), sodium sulfate ($Na_2SO_4$), sodium sulfide ($Na_2S$), $Na_nS$ wherein n is an integer, urea ($CH_4N_2O$), sodium bisulfite ($NaHSO_3$), sulfur dioxide ($SO_2$), anthraquinone ($C_{14}H_8O_2$), ammonia ($NH_3$), methanol ($CH_3OH$), or any combination of the foregoing.

Clause 25. The method of any clause or example herein, in particular, any one of Clauses 23-24, wherein the one or more second chemicals comprises an acid.

Clause 26. The method of any clause or example herein, in particular, any one of Clauses 3-22, wherein the one or more first chemicals comprises an acid solution.

Clause 27. The method of any clause or example herein, in particular, Clause 26, wherein the acid solution comprises formic acid ($CH_2O_2$), acetic acid ($CH_3COOH$), methanol ($CH_3OH$), sodium chlorite ($NaClO_2$), chlorine dioxide ($ClO_2$), hydrochloric acid (HCl), sulfuric acid ($H_2SO_4$), or any combination of the foregoing.

Clause 28. The method of any clause or example herein, in particular, any one of Clauses 26-27, wherein the one or more second chemicals comprises a base.

Clause 29. The method of any clause or example herein, in particular, any one of Clauses 3-22, wherein the one or more first chemicals comprises an organic solvent.

Clause 30. The method of any clause or example herein, in particular, Clause 29, wherein the organic solvent comprises formic acid ($CH_2O_2$), acetic acid ($CH_3COOH$), lactic acid ($CH_3CH(OH)COOH$), methanol ($CH_3OH$), ethanol ($C_2H_5OH$), butanol ($C_4H_9OH$), valerolactone ($C_5H_8O_2$), acetone ($C_3H_6O$) or any combination foregoing.

Clause 31. The method of any clause or example herein, in particular, any one of Clauses 3-22, wherein the one or more first chemicals comprises a solution of choline chloride (ChCl) and oxalic acid ($C_2H_2O_4$).

Clause 32. The method of any clause or example herein, in particular, any one of Clauses 3-22, wherein the one or more first chemicals comprises a deep eutectic solvent.

Clause 33. The method of any clause or example herein, in particular, Clause 32, wherein the deep eutectic solvent comprises choline chloride (ChCl), oxalic acid ($C_2H_2O_4$), lactic acid ($CH_3CH$ (OH) COOH), glycerol ($C_3H_8O_3$), urea ($CH_4N_2O$), betaine ($C_5H_{11}NO_2$), zinc chloride ($ZnCl_2$), aluminum chloride ($AlCl_3$), or any combination of the foregoing.

Clause 34. The method of any clause or example herein, in particular, any one of Clauses 31-33, wherein the one or more second chemicals comprises water.

Clause 35. The method of any clause or example herein, in particular, any one of Clauses 3-34, wherein:

(a) further comprises maintaining the first solution with the biomass immersed therein at a first elevated temperature for a first time;

(b1) further comprises maintaining the first solution with the one or more second chemicals added thereto at a second elevated temperature for a second time; or any combination of the foregoing.

Clause 36. The method of any clause or example herein, in particular, Clause 35, wherein:

the first elevated temperature, the second elevated temperature, or both are at least 90° C.;

the first time, the second time, or both are in a range of 0.5 hours to 4 hours, inclusive; or both of the above.

Clause 37. The method of any clause or example herein, in particular, any one of Clauses 1-36, wherein:

after (a), the hemicellulose in the biomass is also dissolved; and after the in situ regenerating of (b), the hemicellulose remains at least partially dissolved.

Clause 38. The method of any clause or example herein, in particular, any one of Clauses 1-37, wherein:

at least 90% of lignin in the biomass prior to (a) is retained in the slurry after (b);

less than or equal to 10% of hemicellulose in the biomass prior to (a) is retained in the slurry after (b); or any combination of the foregoing.

Clause 39. The method of any clause or example herein, in particular, any one of Clauses 3-38, wherein the removing of (b2) comprises filtering to separate the one or more first chemicals and/or at least some of the one or more second chemicals from the lignin-cellulose slurry.

Clause 40. The method of any clause or example herein, in particular, any one of Clauses 3-39, further comprising:

(d1) after (b2), separating the one or more first chemicals from the one or more second chemicals, wherein:

the separated first chemicals are reused to dissolve lignin in another biomass;

the separated second chemicals are reused in another first solution for in situ regeneration of lignin;

the separating of (d1) comprises filtration, distillation, or both; or any combination of the foregoing.

Clause 41. A bioplastic formed by the method of any clause or example herein, in particular, any one of Clauses 1-40.

Clause 42. A bioplastic comprising:

fibrillated cellulose in a form of microfibrils or nanofibrils having a cross-sectional dimension less than or equal to 300 nm; and regenerated lignin deposited on and forming hydrogen bonds between the fibrillated cellulose so as to form an interconnected network, wherein the regenerated lignin and the fibrillated cellulose are derived from a same biomass that had an intertwined structure of native lignin, hemicellulose, and cellulose, and the regenerated lignin has been chemically modified as compared to the native lignin in the biomass.

Clause 43. The bioplastic of any clause or example herein, in particular, any one of Clauses 41-42, wherein the regenerated lignin has β-O-4 ether bonds cleaved as compared to native lignin in the biomass.

Clause 44. The bioplastic of any clause or example herein, in particular, any one of Clauses 41-43, wherein the regenerated lignin has hydroxyl groups that are more phenolic as compared to hydroxyl groups of the native lignin in the biomass.

Clause 45. The bioplastic of any clause or example herein, in particular, any one of Clauses 41-44, wherein —COO functional groups of the fibrillated cellulose have a negative charge.

Clause 46. The bioplastic of any clause or example herein, in particular, any one of Clauses 41-45, wherein the biomass comprises a portion of plant material.

Clause 47. The bioplastic of any clause or example herein, in particular, Clause 46, wherein the plant material comprises wood, bamboo, grass, hemp, or reed.

Clause 48. The bioplastic of any clause or example herein, in particular, any one of Clauses 41-47, where the bioplastic is substantially devoid of any hemicellulose.

Clause 49. The bioplastic of any clause or example herein, in particular, any one of Clauses 41-48, wherein the interconnected network forms an aerogel.

Clause 50. The bioplastic of any clause or example herein, in particular, any one of Clauses 41-49, further comprising a polymer infiltrating or forming a part of the interconnected network.

Clause 51. The bioplastic of any clause or example herein, in particular, Clause 50, wherein the polymer comprises a natural resin or rosin, polymethyl methacrylate (PMMA), polyvinyl alcohol (PVA), polydimethylsiloxane (PDMS), polyethylene terephthalate (PET), polycarbonate (PC), polyethylene glycol (PEO), polyamide (PA), polyethylene terephthalate (PET), polybutylene terephthalate (PBT), polytrimethylene terephthalate (PTT), polyacrylonitrile (PAN), polycaprolactam (Nylon 6), poly(m-phenylene isophthalamide) (PMIA), poly(p-phenylene terephthalamide) (PPTA), polyurethane (PU), polycarbonate (PC), polypropylene (PP), high-density polyethylene (HDPE), polystyrene (PS), polycaprolactone (PCL), polybutylene succinate (PBS), polyglycolide (PGA), poly(methyl methacrylate (PMMA), acrylonitrile butadiene styrene (ABS), polymethysilane (PMS), or any combination of the foregoing.

Clause 52. The bioplastic of any clause or example herein, in particular, any one of Clauses 41-49, wherein the bioplastic consists of the fibrillated cellulose and the regenerated lignin.

Clause 53. The bioplastic of any clause or example herein, in particular, any one of Clauses 41-49, wherein the bioplastic consists essentially of the fibrillated cellulose and the regenerated lignin.

Clause 54. A structure comprising the bioplastic of any clause or example herein, in particular, any one of Clauses 41-53.

Clause 55. The structure of any clause or example herein, in particular, Clause 54, further comprising:

a coating disposed on one or more exterior surfaces of the bioplastic;

a sub-structure coupled to the bioplastic, the sub-structure having a different material composition from the bioplastic; or any combination of the foregoing.

Clause 56. A slurry comprising:

a solution;

fibrillated cellulose within the solution and in a form of microfibrils or nanofibrils having a cross-sectional dimension less than or equal to 300 nm; and regenerated lignin within the solution, the regenerated lignin being deposited on and forming hydrogen bonds between the fibrillated cellulose, wherein the regenerated lignin and the fibrillated cellulose are derived from a same biomass that had an intertwined structure of native lignin, hemicellulose, and cellulose, and the regenerated lignin has been chemically modified as compared to the native lignin in the biomass.

Clause 57. The slurry of any clause or example herein, in particular, Clause 56, wherein the solution comprises water.

Clause 58. The slurry of any clause or example herein, in particular, any one of Clauses 56-57, wherein a content of lignin-cellulose solids in the solution is in a range of 5 wt % to 20 wt %, inclusive.

Clause 59. The slurry of any clause or example herein, in particular, any one of Clauses 56-58, wherein:

the regenerated lignin has β-O-4 ether bonds cleaved as compared to native lignin in the biomass;

the regenerated lignin has hydroxyl groups that are more phenolic as compared to hydroxyl groups of the native lignin in the biomass;

—COO functional groups of the fibrillated cellulose have a negative charge; or any combination of the foregoing.

Clause 60. The slurry of any clause or example herein, in particular, any one of Clauses 56-59, wherein the biomass comprises a portion of plant material.

Clause 61. The slurry of any clause or example herein, in particular, any one of Clauses 56-60, where the solution is substantially devoid of any hemicellulose.

Clause 62. The slurry of any clause or example herein, in particular, any one of Clauses 56-61, further comprising a polymer or a precursor thereof within the solution.

Clause 63. The slurry of any clause or example herein, in particular, Clause 62, wherein the polymer comprises a natural resin or rosin, polymethyl methacrylate (PMMA), polyvinyl alcohol (PVA), polydimethylsiloxane (PDMS), polyethylene terephthalate (PET), polycarbonate (PC), polyethylene glycol (PEO), polyamide (PA), polyethylene terephthalate (PET), polybutylene terephthalate (PBT), polytrimethylene terephthalate (PTT), polyacrylonitrile (PAN), polycaprolactam (Nylon 6), poly(m-phenylene isophthalamide) (PMIA), poly(p-phenylene terephthalamide) (PPTA), polyurethane (PU), polycarbonate (PC), polypropylene (PP), high-density polyethylene (HDPE), polystyrene (PS), polycaprolactone (PCL), polybutylene succinate (PBS), polyglycolide (PGA), poly(methyl methacrylate (PMMA), acrylonitrile butadiene styrene (ABS), polymethysilane (PMS), or any combination of the foregoing.

Clause 64. The slurry of any clause or example herein, in particular, any one of Clauses 56-61, wherein the slurry consists of the solution, the fibrillated cellulose, and the regenerated lignin.

Clause 65. The slurry of any clause or example herein, in particular, any one of Clauses 56-61, wherein the slurry consists essentially of the solution, the fibrillated cellulose, and the regenerated lignin.

CONCLUSION

Any of the features illustrated or described with respect to FIGS. 1-8F and Clauses 1-65 can be combined with any other features illustrated or described with respect to FIGS. 1-8F and Clauses 1-65 to provide materials, structures, methods, and embodiments not otherwise illustrated or specifically described herein. All features described herein are independent of one another and, except where structurally impossible, can be used in combination with any other feature described herein.

In view of the many possible embodiments to which the principles of the disclosed technology may be applied, it should be recognized that the illustrated embodiments are only preferred examples and should not be taken as limiting the scope of the disclosed technology. Rather, the scope is defined by the following claims. We therefore claim all that comes within the scope and spirit of these claims.

The invention claimed is:

1. A method comprising:

(a) subjecting a biomass to a first chemical treatment by immersing the biomass in a first solution comprising a deep eutectic solvent that comprises choline chloride and oxalic acid, the biomass comprising an intertwined structure of lignin, hemicellulose, and cellulose, the intertwined structure being comprised of microbundles having a cross-sectional diameter of at least 50 μm, the first chemical treatment being effective to dissolve the lignin in the biomass and to fibrillate the cellulose into microfibrils, nanofibrils, or both microfibrils and nanofibrils;

(b) after (a), adding one or more second chemicals to the first solution and then mechanically agitating for a predetermined time such that at least some of the dissolved lignin is in situ regenerated, the regenerated lignin being deposited on the cellulose microfibrils and/or nanofibrils and forming hydrogen bonds between adjacent ones of the cellulose microfibrils and/or nanofibrils;

(c) after (b), removing the deep eutectic solvent from the first solution while retaining the regenerated lignin and cellulose microfibrils and/or nanofibrils in the first solution so as to form a slurry of lignin-cellulose solids in solution; and (d) after (c), drying the slurry to form a solid lignocellulosic bioplastic from the lignin-cellulose solids, the bioplastic comprising an interconnected network formed by the cellulose microfibrils and/or nanofibrils bound together by the regenerated lignin.

2. The method of claim 1, further comprising:

after (c) and prior to (d), depositing the slurry in a mold or cast, wherein the mold or cast defines a shape of the lignocellulosic bioplastic after (d).

3. The method of claim 1, further comprising:

after (c) and prior to (d), depositing the slurry using a printhead or additive manufacturing nozzle, wherein locations of the depositing define a shape of the lignocellulosic bioplastic after (d).

4. The method of claim 1, wherein the biomass comprises wood, bamboo, grass, hemp, or reed.

5. The method of claim 1, wherein, after (a):

the lignin in the slurry has β-O-4 ether bonds cleaved as compared to native lignin in the biomass prior to (a);

hydroxyl groups of the lignin are more phenolic than before (a); and a —COO functional group of the cellulose has a negative charge.

6. The method of claim 1, wherein:

after (a), each of the microfibrils and/or nanofibrils has a cross-sectional dimension less than or equal to 300 nm.

7. The method of claim 1, wherein:

at least 90% of lignin in the biomass prior to (a) is retained in the slurry after (c); and less than or equal to 10% of hemicellulose in the biomass prior to (a) is retained in the slurry after (c).

8. The method of claim 1, wherein:

(c) the drying of (d) comprises pressing the slurry while removing the one or more second chemicals therefrom.

9. The method of claim 1, further comprising:

prior to (d), adding a polymer or a precursor thereof to the first solution, wherein, after (d), the solid bioplastic is a hybrid structure formed by a combination of lignin-cellulose solids and the polymer.

10. The method of claim 9, wherein the polymer comprises a natural resin or rosin, polymethyl methacrylate (PMMA), polyvinyl alcohol (PVA), polydimethylsiloxane (PDMS), polyethylene terephthalate (PET), polycarbonate (PC), polyethylene glycol (PEO), polyamide (PA), polybutylene terephthalate (PBT), polytrimethylene terephthalate (PTT), polyacrylonitrile (PAN), polycaprolactam (Nylon 6), poly(m-phenylene isophthalamide) (PMIA), poly(p-phenylene terephthalamide) (PPTA), polyurethane (PU), polypropylene (PP), high-density polyethylene (HDPE), polystyrene (PS), polycaprolactone (PCL), polybutylene succinate (PBS), polyglycolide (PGA), acrylonitrile butadiene styrene (ABS), polymethylsilane (PMS), or any combination of the foregoing.

11. The method of claim 1, wherein after (c) and prior to (d), a content of lignin-cellulose solids in the slurry is in a range of 5 wt % to 20 wt %, inclusive.

12. The method of claim 1, wherein the one or more second chemicals comprises water.

13. The method of claim 1, wherein the removing of (c) comprises filtering to separate the deep eutectic solvent and at least some of the one or more second chemicals from the first solution.

14. The method of claim 13, further comprising:

(e) after (c), separating the deep eutectic solvent from the one or more second chemicals, wherein:

the separated deep eutectic solvent is reused to dissolve lignin in another biomass;

the separated second chemicals are reused in another first solution for in situ regeneration of lignin; and the separating of (e) comprises filtration, distillation, or both.

15. The method of claim 1, further comprising:

after (d), pressing the solid lignocellulosic bioplastic to form a densified bioplastic.

16. The method of claim 1, wherein:

the one or more second chemicals comprises water;

during the first chemical treatment of (a), the first solution is maintained at a first temperature of at least 90° C. for a first time; and the predetermined time for the mechanically agitating in (b) is 0.5-4 hours, inclusive.

17. The method of claim 16, wherein the first temperature is about 110° C.

18. The method of claim 1, wherein:

the first chemical treatment of (a) is also effective to dissolve the hemicellulose in the biomass; and after (b), at least part of the hemicellulose remains dissolved in the first solution.

* * * * *